US012637311B2

(12) United States Patent
Ogawa et al.

(10) Patent No.: US 12,637,311 B2
(45) Date of Patent: May 26, 2026

(54) TRANSPORT DEVICE AND RECORDING DEVICE

(71) Applicant: SEIKO EPSON CORPORATION, Tokyo (JP)

(72) Inventors: Masashi Ogawa, Shiojiri (JP); Ryoichi Morisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 107 days.

(21) Appl. No.: 18/616,296

(22) Filed: Mar. 26, 2024

(65) Prior Publication Data

US 2024/0327157 A1 Oct. 3, 2024

(30) Foreign Application Priority Data

Mar. 28, 2023 (JP) ..... 2023-052016

(51) Int. Cl.
*B65H 3/66* (2006.01)
*B65H 3/06* (2006.01)
*B65H 3/68* (2006.01)

(52) U.S. Cl.
CPC ..... *B65H 3/66* (2013.01); *B65H 3/0638* (2013.01); *B65H 3/68* (2013.01)

(58) Field of Classification Search
CPC ..... B65H 5/36; B65H 5/38; B65H 3/0638; B65H 3/66; B65H 3/68
See application file for complete search history.

(56) References Cited

U.S. PATENT DOCUMENTS

| | | | | |
|---|---|---|---|---|
| 8,585,039 | B2 * | 11/2013 | Murata | B65H 1/266 271/18 |
| 9,624,057 | B2 * | 4/2017 | Itabashi | B65H 3/68 |
| 10,040,652 | B2 * | 8/2018 | Fujita | B65H 3/0638 |
| 10,435,258 | B2 * | 10/2019 | Aono | B65H 27/00 |
| 10,611,587 | B2 * | 4/2020 | Kato | B65H 3/0684 |
| 11,091,334 | B2 * | 8/2021 | Aono | B65H 27/00 |
| 11,572,240 | B2 * | 2/2023 | Koga | B65H 3/66 |
| 12,180,024 | B2 * | 12/2024 | Yoshida | G03G 15/0891 |

FOREIGN PATENT DOCUMENTS

JP 2009-269686 A 11/2009

* cited by examiner

*Primary Examiner* — Patrick Cicchino
(74) *Attorney, Agent, or Firm* — WORKMAN NYDEGGER

(57) ABSTRACT

A transport device configured to transport a medium stacked on a loading section is disclosed. The transport device includes a transport roller and a separation roller and is configured to separate the medium one sheet at a time. A rotation shaft is attached to the separation roller and a movable guide member guides the medium between the transport roller and the separation roller, to be aligned with the separation roller in a shaft direction of the rotation shaft, and to be movable in the shaft direction. The separation roller is attachable to and detachable from the rotation shaft by moving in the shaft direction. By moving in the shaft direction, the movable guide member is displaced between a guide position at which the medium is guided and a retracted position at which the separation roller is movable in the shaft direction with respect to the rotation shaft.

16 Claims, 17 Drawing Sheets

TRANSPORT DEVICE AND RECORDING DEVICE

The present application is based on, and claims priority from JP Application Serial Number 2023-052016, filed Mar. 28, 2023, the disclosure of which is hereby incorporated by reference herein in its entirety.

BACKGROUND

1. Technical Field

The present disclosure relates to a transport device and a recording device.

2. Related Art

JP-A-2009-269686 describes a transport device including a separation roller that separates a medium, a rotation shaft to which the separation roller is attached, and a guide member that guides the medium to the separation roller. The separation roller and the guide member are arranged in the shaft direction of the rotation shaft. The separation roller is attached to and detached from the rotation shaft by moving in the shaft direction. The guide member retracts from the side of the separation roller by rotating. Thus, the separation roller can be replaced.

JP-A-2009-269686 shows that the transport device needs to secure a space in which the guide member rotates. There is a risk that the equipment will become larger.

SUMMARY

To solve the above problems, a transport device configured to transport a medium stacked on a loading section, the transport device includes a transport roller configured to transport the medium, a separation roller opposed to the transport roller and separating the medium one sheet at a time, a rotation shaft to which is attached the separation roller, and a movable guide member configured to guide the medium between the transport roller and the separation roller, to be aligned with the separation roller in a shaft direction of the rotation shaft, and to be movable in the shaft direction, wherein the separation roller is attachable to and detachable from the rotation shaft by moving in the shaft direction and by moving in the shaft direction, the movable guide member is displaced between a guide position at which the medium is guided and a retracted position at which the separation roller is movable in the shaft direction with respect to the rotation shaft.

To solve the above problems, a recording device includes a loading section configured to stack a medium, a transport roller configured to transport the medium stacked on the loading section, a recording section configured to record an image on a medium transported by the transport roller, a separation roller opposed to the transport roller and separating the medium one sheet at a time, a rotation shaft to which is attached the separation roller and a movable guide member configured to guide the medium between the transport roller and the separation roller, to be aligned with the separation roller in a shaft direction of the rotation shaft, and to be movable in the shaft direction, wherein the separation roller is attachable to and detachable from the rotation shaft by moving in the shaft direction, and by moving in the shaft direction, the movable guide member is displaced between a guide position at which the medium is guided and a retracted position at which the separation roller is movable in the shaft direction with respect to the rotation shaft.

DESCRIPTION OF EMBODIMENTS

Figure 1:
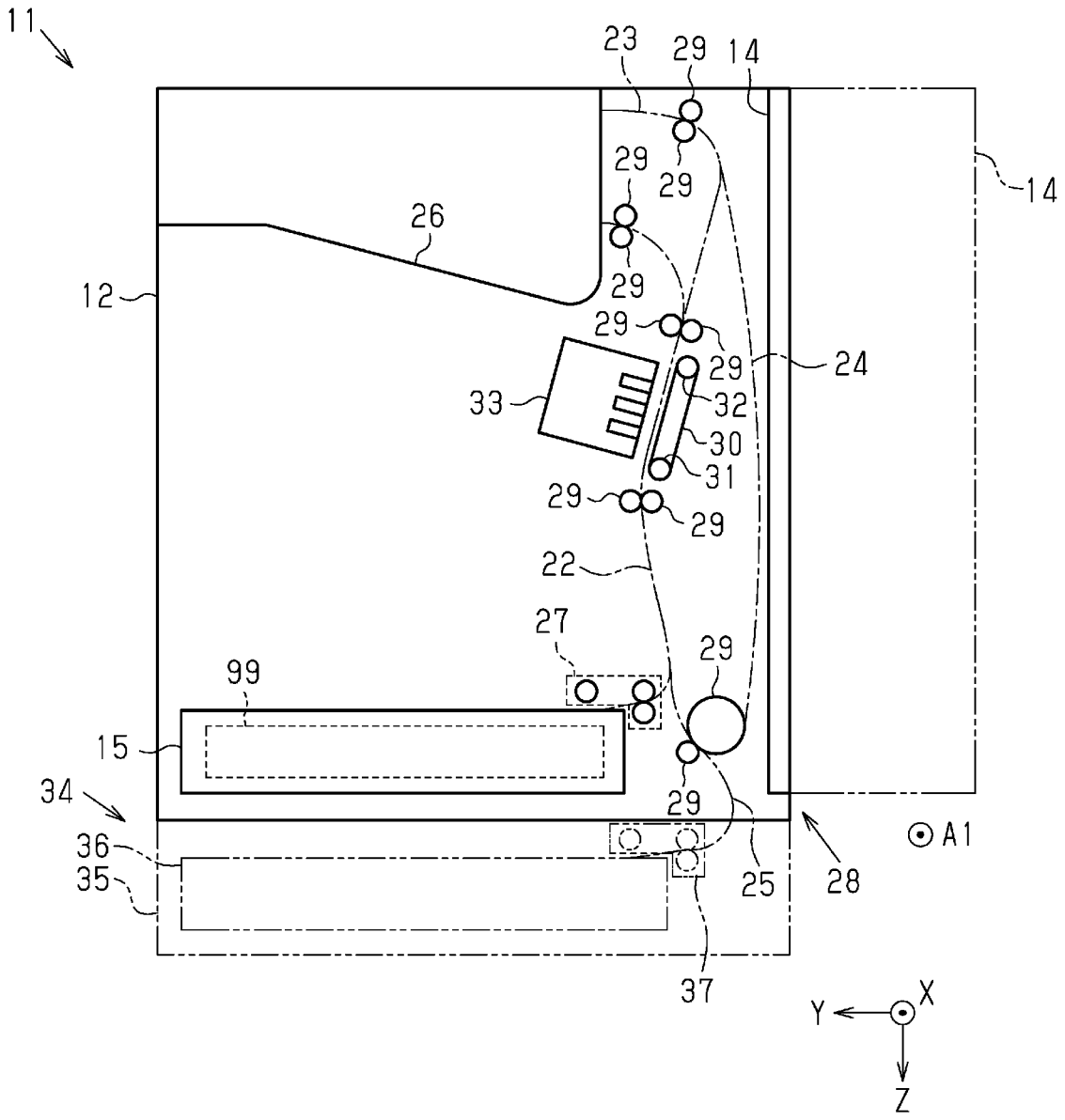
FIG. 1 is a front view showing an embodiment of a recording device including a transport device.

An embodiment of a recording device including a transport device will be described below with reference to the drawings. The recording device is, for example, an inkjet type printer which records an image such as a character or a photograph by ejecting ink which is an example of a liquid onto a medium such as a sheet or a fabric. The recording device is not limited to an inkjet recording device, but may perform recording by a tonerjet recording device or a dot impact recording device. In the drawings, a space in which the recording device is installed is indicated by an X-axis, a Y-axis, and a Z-axis. The X-axis, the Y-axis, and the Z-axis are orthogonal to each other.

Recording Device

As shown in FIG. 1, a recording device 11 includes a main body 12. The main body 12 houses various components included in the recording device 11. The shape of the main body 12 is, for example, a rectangular parallelepiped shape or an approximately brick-like shape. As an example, the main body 12 is set on a horizontal plane. The horizontal plane is, for example, a plane extending in the X-axis and the Y-axis.

Figure 2:
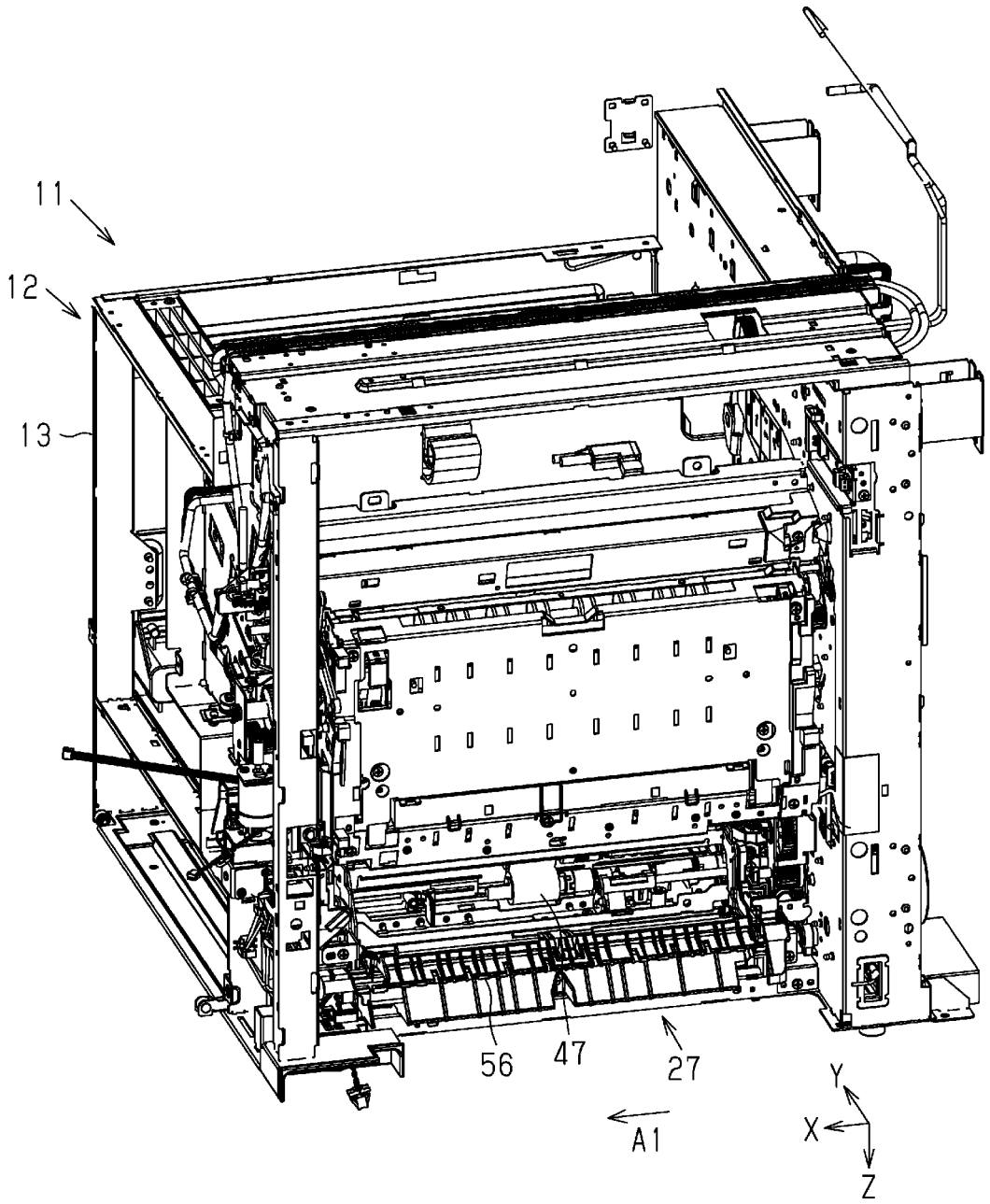
FIG. 2 is a perspective view of the main body.

As shown in FIG. 2, the main body 12 includes a body frame 13. The body frame 13 constitutes an outer shell of the recording device 11. The body frame 13 is formed of, for example, a sheet metal. Accordingly, the rigidity of the main body 12 is secured. The main body 12 includes, for example, the body frame 13 and a resin cover attached to the body frame 13.

As shown in FIG. 1, the recording device 11 includes a door 14. The door 14 is attached to the main body 12. The door 14 is configured to open and close with respect to the main body 12. For example, the door 14 is positioned so as to cover a side surface of the main body 12. As an example, the door 14 opens horizontally. That is, the door 14 rotates about an axis extending in the vertical direction. As an example, the vertical direction extends in the Z-axis. Thus, the door 14 rotates about an axis extending in the Z-axis. In FIG. 1, the door 14 indicated by solid line is closed. In FIG. 1, the door 14 indicated by two dot chain line is open. By opening the door 14, the inside of the main body 12, that is, the inside of the body frame 13 is exposed.

The recording device 11 includes a loading section 15. The loading section 15 is configured such that one or more sheets of medium 99 can be stacked. For example, a plurality of sheets of the medium 99 are stacked on the loading section 15. The loading section 15 is mounted on the main body 12. The loading section 15 is arranged at a lower portion of the main body 12. As an example, the loading section 15 is configured to be insertable into and removable from the main body 12. The loading section 15 is held in the body frame 13 by being inserted into the main body 12. The loading section 15 is, for example, a cassette. The user can pull out the loading section 15 from the main body 12 to refill the loading section 15 with the medium 99. The loading section 15 is not limited to a cassette and may be a tray.

Figure 3:
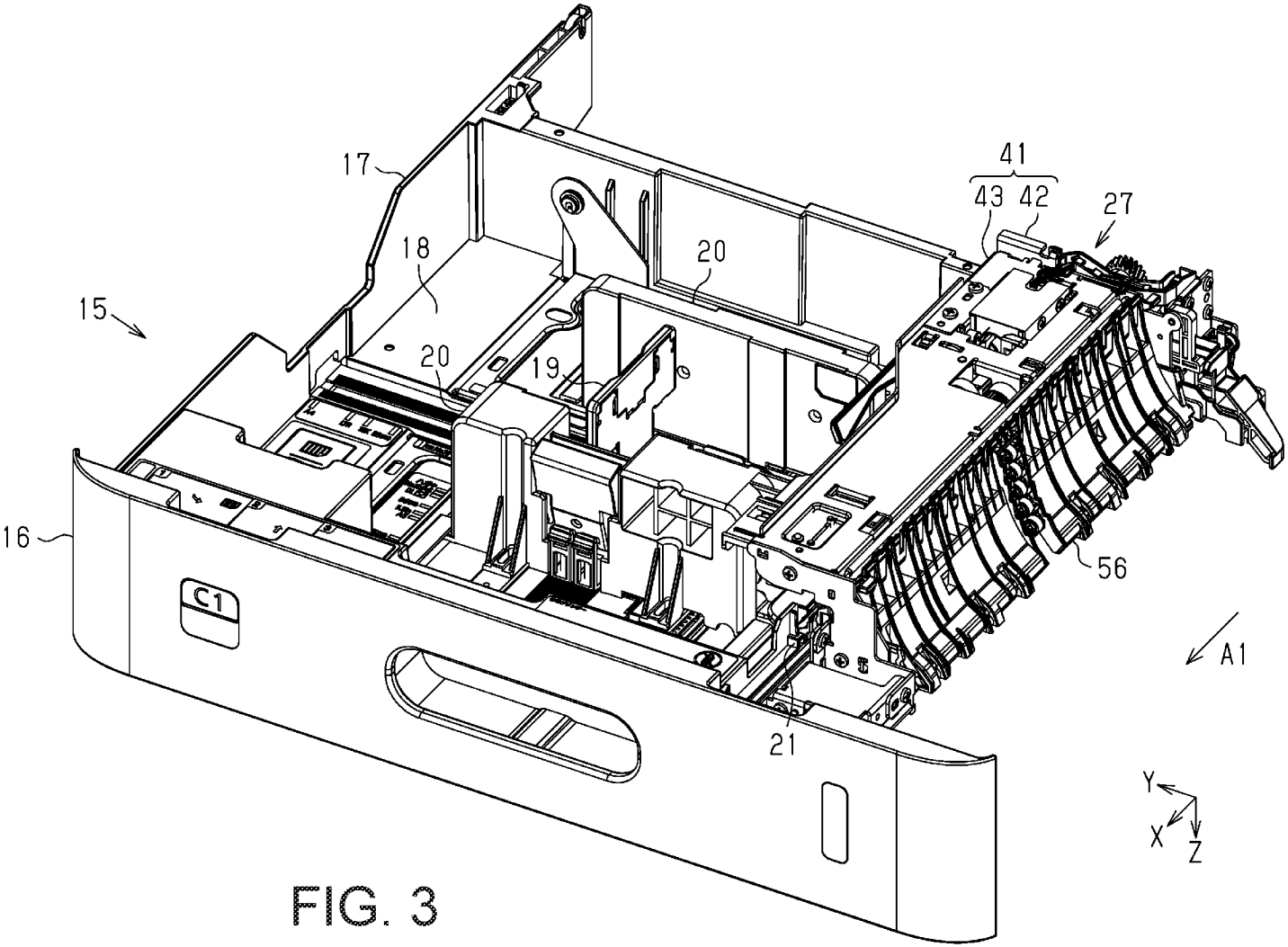
FIG. 3 is a perspective view of the loading section.

As shown in FIG. 3, the loading section 15 has a handle portion 16 and a loading portion 17. The handle portion 16 is a portion on which a hand of a user is hooked. The loading portion 17 is a section in which the medium 99 is stacked. The loading portion 17 has a loading face 18. The loading face 18 is a surface on which the medium 99 is stacked. The loading portion 17 supports the medium 99 with the loading face 18.

The loading section 15 has one or more edge guides. The loading section 15 has, for example, a rear edge guide 19 and a side edge guide 20. The edge guide is mounted on the loading portion 17. The edge guide is configured to move on the loading face 18. The edge guide contacts the edges of the medium 99 and aligns the medium 99. The rear edge guide 19 contacts a rear end of the medium 99. The side edge guide 20 contacts a side edge of the medium 99.

The loading section 15 may have a contact member 21. The contact member 21 is mounted on the loading portion 17. The contact member 21 contacts a movable guide member 58 (to be described later). The contact member 21 contacts the movable guide member 58 by the loading section 15 being inserting into the main body 12. Thus, the contact member 21 restricts the movement of the movable guide member 58.

As shown in FIG. 1, a transport path 22 is arranged in the recording device 11. The medium 99 is transported along the transport path 22 in the recording device 11. The transport path 22 is an area formed by the components of the recording device 11. The transport direction in which the medium 99 is transported is a direction in which the transport path 22 extends. As an example, the transport path 22 extends while changing its direction in a plane defined by the Y-axis and the Z-axis. Therefore, the transport direction is a direction in the plane defined by the Y-axis and the Z-axis. The transport path 22 extends from the loading section 15 toward the outside of the main body 12. An image is recorded on the medium 99 in while being transported along the transport path 22. The medium 99 is discharged to the outside of the main body 12 by being transported along the transport path 22.

In the recording device 11, a switchback path 23 and a reversing path 24 may be arranged in addition to the transport path 22. The switchback path 23 and the reversing path 24 are used when images are recorded on both sides of the medium 99.

The switchback path 23 is a path in which the medium 99 is switched back, that is, a direction in which the medium 99 travels is inverted. The switchback path 23 extends so as to branch from the transport path 22. A medium 99 having an image recorded on one side thereof is transported to the switchback path 23.

The reversing path 24 is a path for reversing the posture of the medium 99. The reversing path 24 is coupled to the switchback path 23. The medium 99 switched back in the switchback path 23 is transported to the reversing path 24. The reversing path 24 is coupled to the transport path 22. The medium 99 is returned to the transport path 22 after the posture of the medium 99 is inverted by being transported through the reversing path 24. The medium 99 is transported along the transport path 22 again, and an image is recorded on the medium 99 again. As a result, images are recorded on both sides of the medium 99.

An additional transport path 25 may be arranged in the recording device 11. The additional transport path 25 is a path along which a medium 99 housed in an additional unit 34 (to be described later) is transported. The additional transport path 25 joins, for example, the reversing path 24. The medium 99 housed in the additional unit 34 is transported to the transport path 22 through the additional transport path 25 and the reversing path 24.

The recording device 11 includes a discharge tray 26. The discharge tray 26 receives the recorded medium 99. Specifically, the discharge tray 26 receives the medium 99 discharged to the outside of the main body 12 through the transport path 22. As an example, the discharge tray 26 is composed by an exterior panel of the main body 12.

The recording device 11 includes a transport device 27. The transport device 27 is a device that transports the medium 99 stacked on the loading section 15. The transport device 27 transports the medium 99 toward a recording section 33 (to be described later). The transport device 27 is housed in the main body 12. The transport device 27 is mounted on the body frame 13. The transport device 27 may be mounted on the loading section 15. The transport device 27 is exposed to the outside when the door 14 is opened. Therefore, the user can perform maintenance of the transport device 27 by opening the door 14. The transport device 27 will be described in detail later.

The recording device 11 includes a transport section 28. The transport section 28 is configured to transport the medium 99. Specifically, the transport section 28 transports the medium 99 transported by the transport device 27. The transport section 28 transports the medium 99 along the transport path 22. The transport section 28 may transport the medium 99 along the switchback path 23, the reversing path 24, and the additional transport path 25.

The transport section 28 includes one or more rollers. As an example, the transport section 28 includes a plurality of body rollers 29. The plurality of body rollers 29 are arranged, for example, in the transport path 22, the switchback path 23, the reversing path 24, and the additional transport path 25. The plurality of body rollers 29 are mounted on the main body 12, the door 14, and the like.

The transport section 28 includes a transport belt 30, a first pulley 31, and a second pulley 32. The transport belt 30 is wound around the first pulley 31 and the second pulley 32. The transport belt 30 attracts the medium 99 by, for example, electrostatic suction. Accordingly, the transport belt 30 supports the medium 99. The transport belt 30 may be configured to attract the medium 99, for example, by a negative pressure due to suction. The first pulley 31 and the second pulley 32 are arranged along the transport path 22. The transport belt 30 circulates by rotating the first pulley 31 and the second pulley 32. As a result, the medium 99 supported by the transport belt 30 is transported. The transport belt 30, for example, transports the medium 99 obliquely upward. The recording device 11 may include a simple support base instead of the transport belt 30.

The recording device 11 includes a recording section 33. The recording section 33 is configured to record an image on the medium 99. As an example, the recording section 33 records an image on the medium 99 by ejecting a liquid onto the medium 99. The recording section 33 is, for example, a line head configured to simultaneously eject liquid over the width of the medium 99. The recording section 33 may be a serial head that scans the medium 99.

The recording section 33 is positioned so as to face the transport belt 30. The recording section 33 is positioned obliquely above the transport belt 30. The recording section 33 records an image on the medium 99 supported by the transport belt 30.

The recording device 11 may include one or a plurality of additional units 34. The additional unit 34 is added to the recording device 11. The additional unit 34 is disposed below the main body 12. The additional unit 34 is configured to house the medium 99. By adding the additional unit 34 to the recording device 11, the recording device 11 can record an image not only on the medium 99 transported from the loading section 15 but also on the medium 99 transported from the additional unit 34.

The additional unit 34 has an additional main body 35 and an additional loading section 36. The additional main body 35 is mounted on the main body 12. The additional loading section 36 houses the medium 99. The additional loading section 36 has the same configuration as the loading section 15. The additional loading section 36 is, for example, a cassette. The additional loading section 36 can be inserted into and removed from the additional main body 35.

The additional unit 34 includes an additional transport device 37. The additional transport device 37 is mounted on the additional main body 35. The additional transport device 37 may be mounted on the additional loading section 36. The additional transport device 37 may have the same configuration as the transport device 27. A path coupled to the additional transport path 25 is formed in the additional transport device 37. Through this path, the additional transport device 37 transports the medium 99 from the additional loading section 36 to the main body 12.

Transport Device

Next, the transport device 27 will be described.

Figure 4:
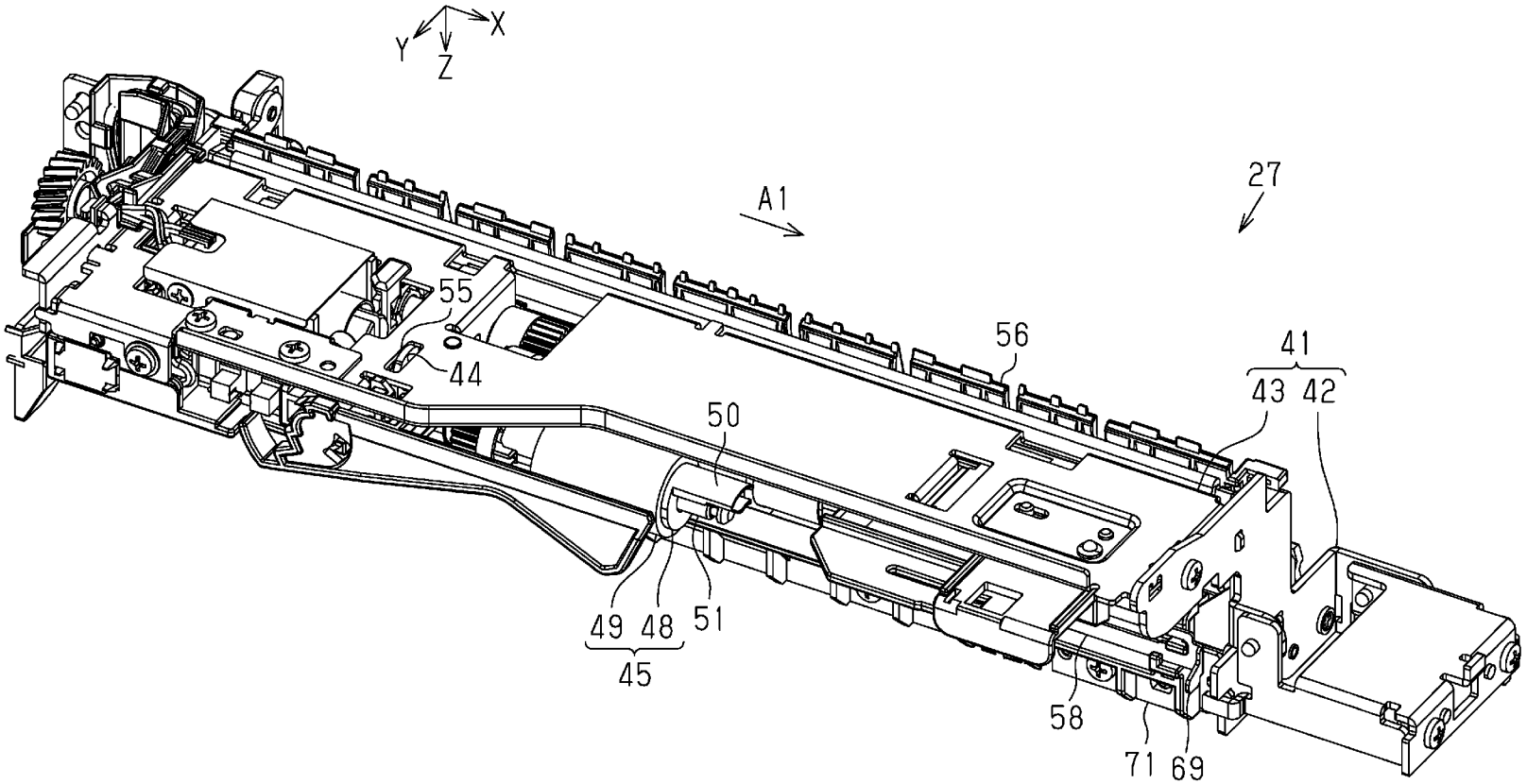
FIG. 4 is a perspective view of the transport device.
Figure 5:
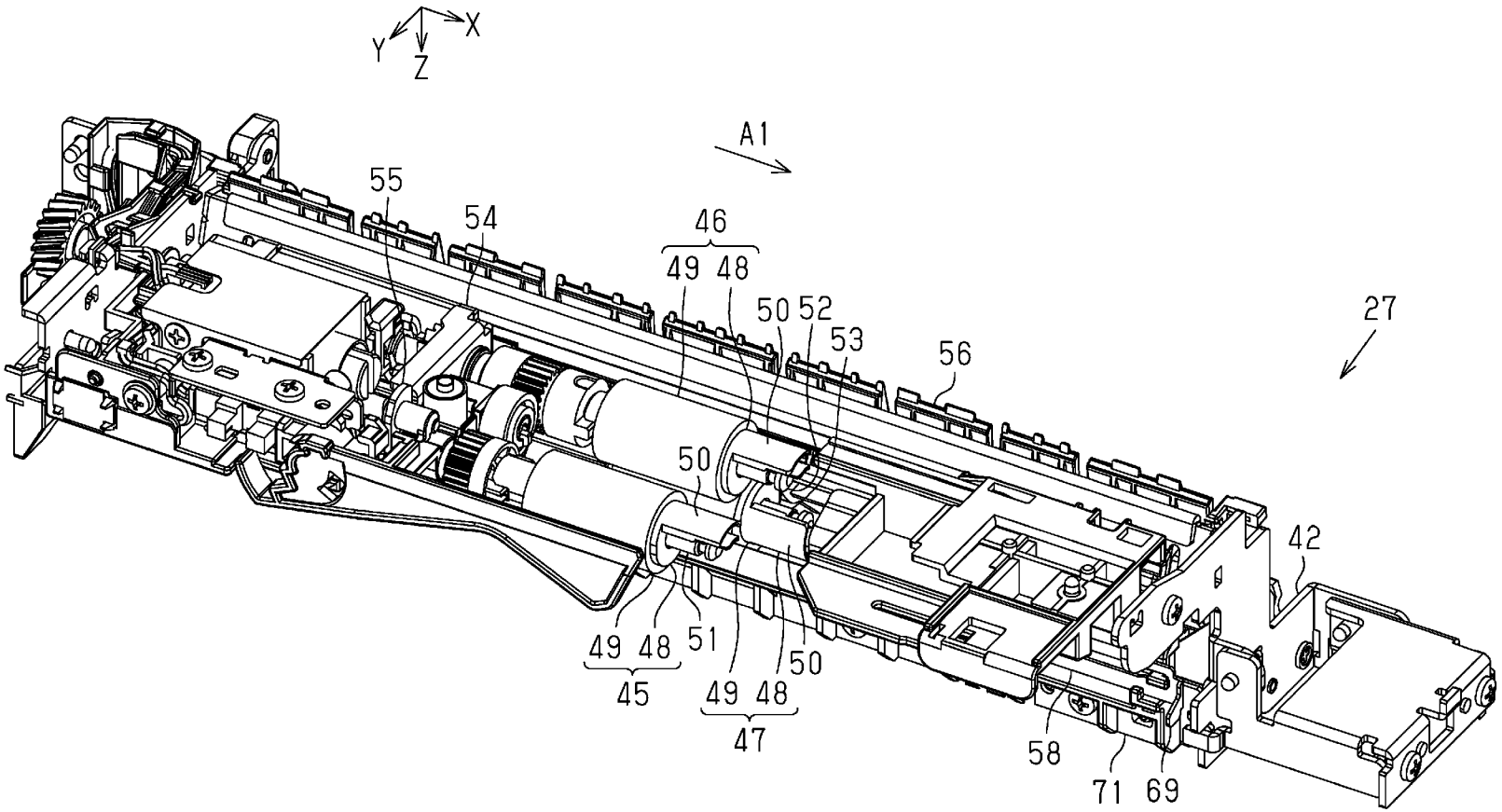
FIG. 5 is a perspective view in which the top frame is removed from the transport device of FIG. 4.
Figure 6:
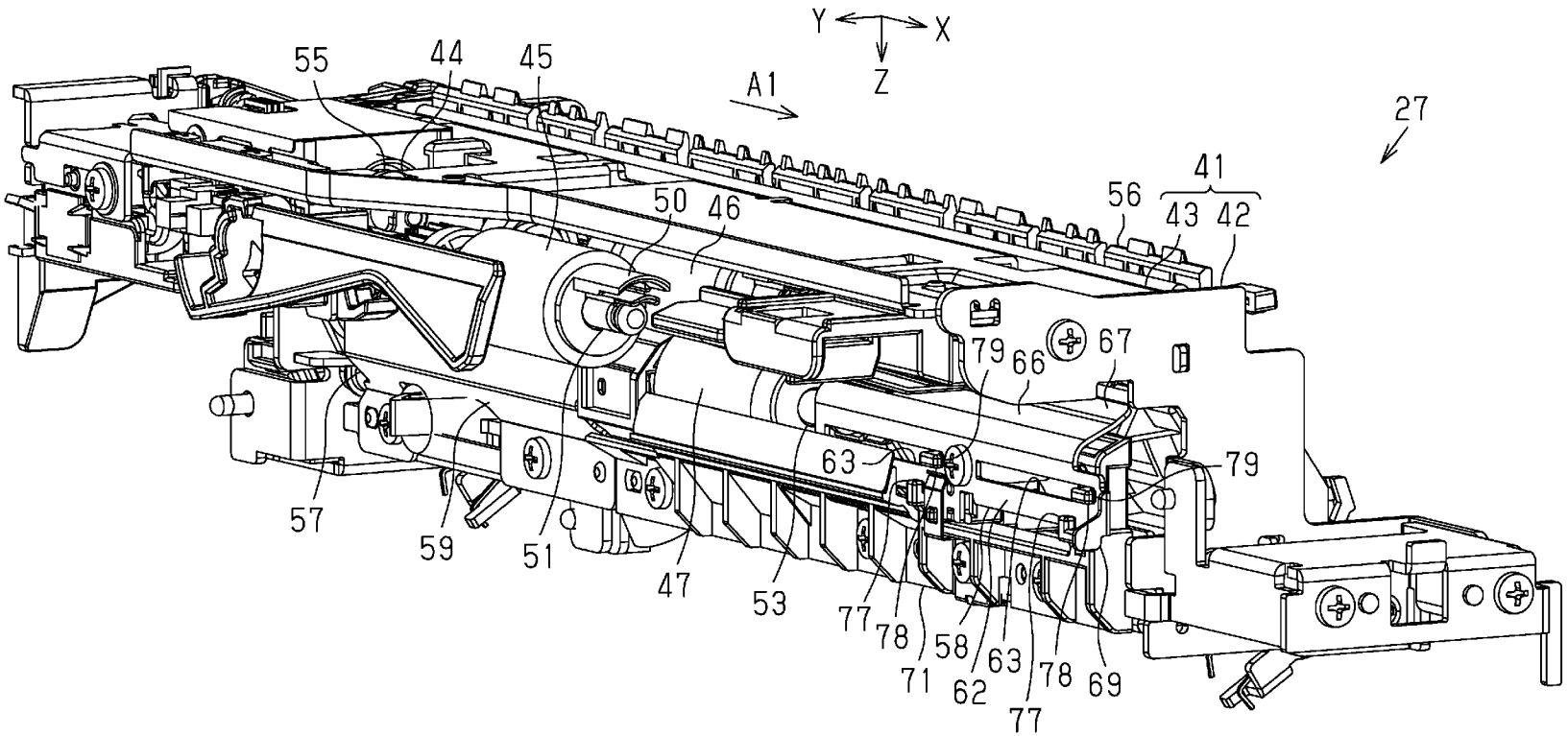
FIG. 6 is a perspective view from a different angle than FIG. 4.
Figure 7:
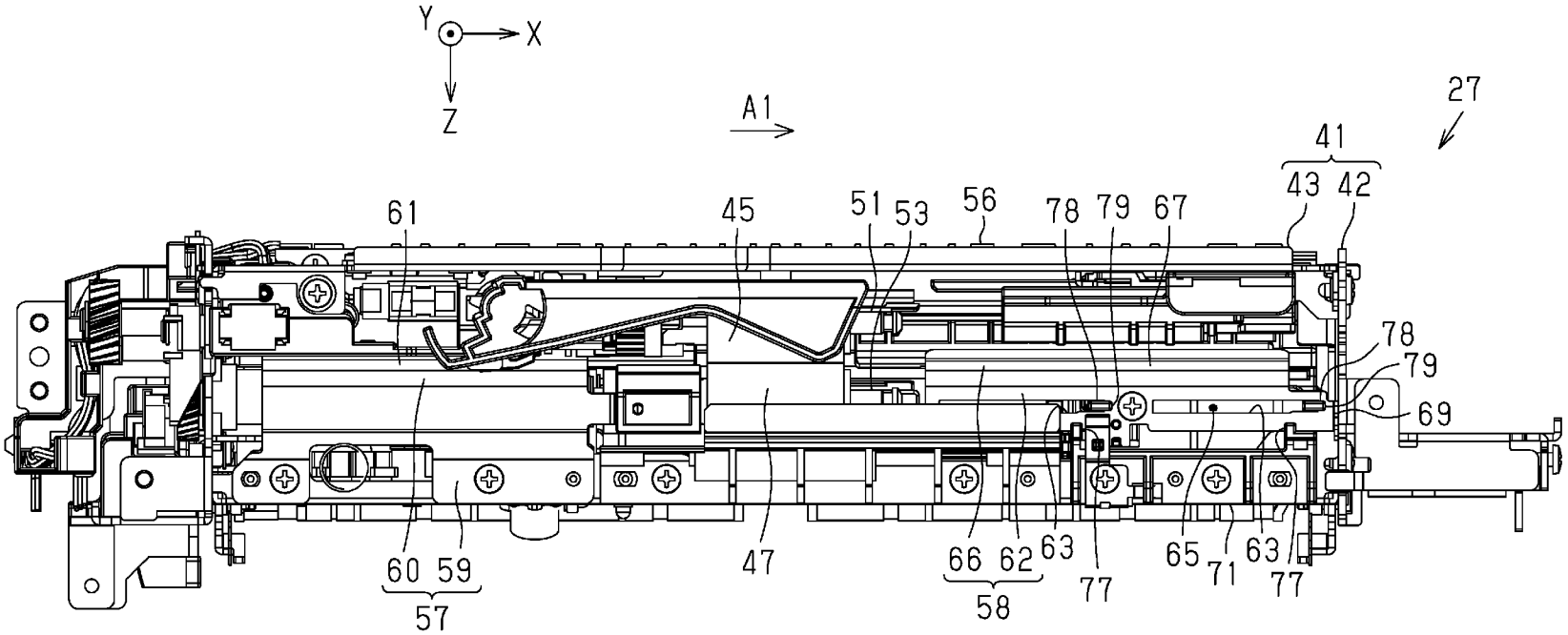
FIG. 7 is a front view of the transport device.
Figure 8:
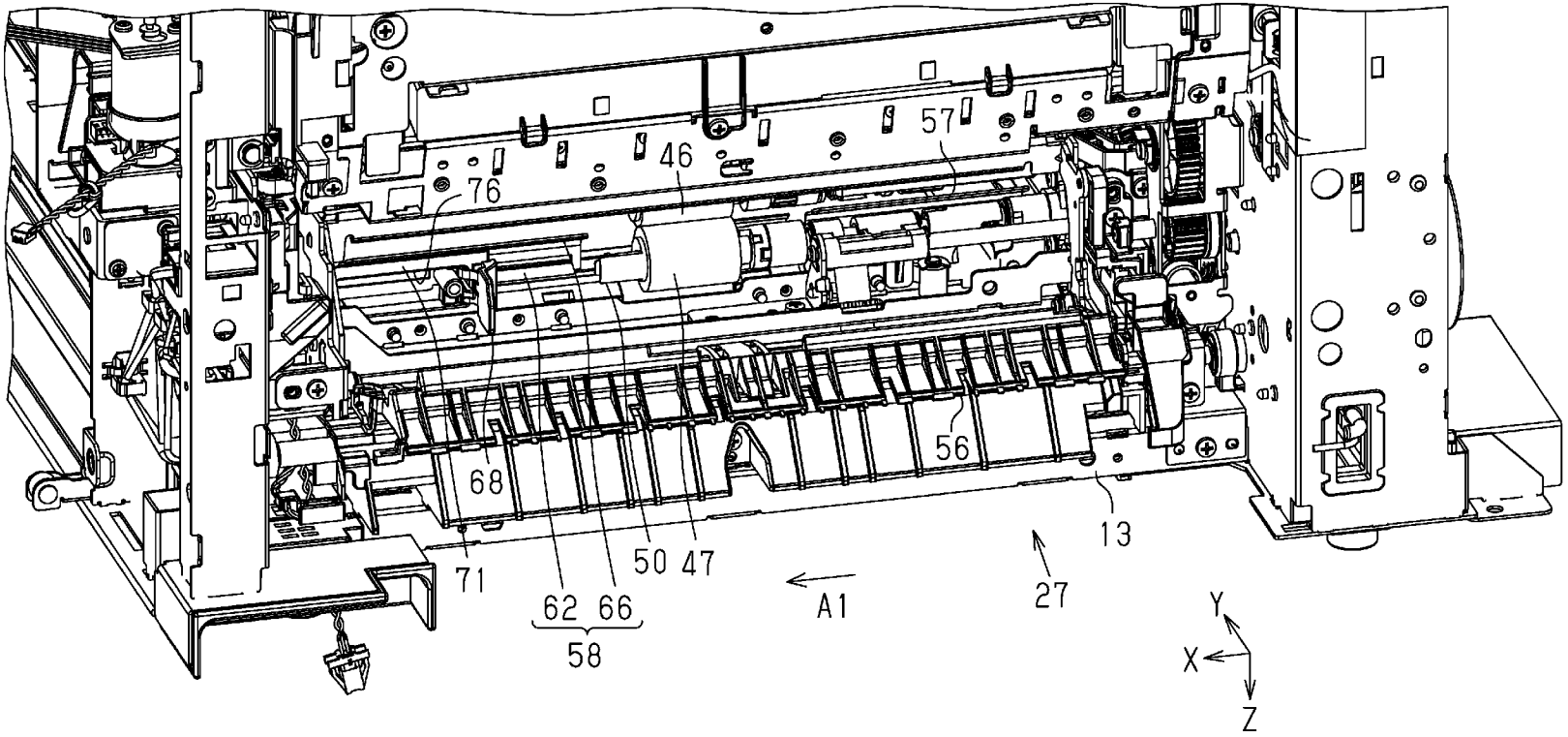
FIG. 8 is an enlarged view of FIG. 2.
Figure 9:
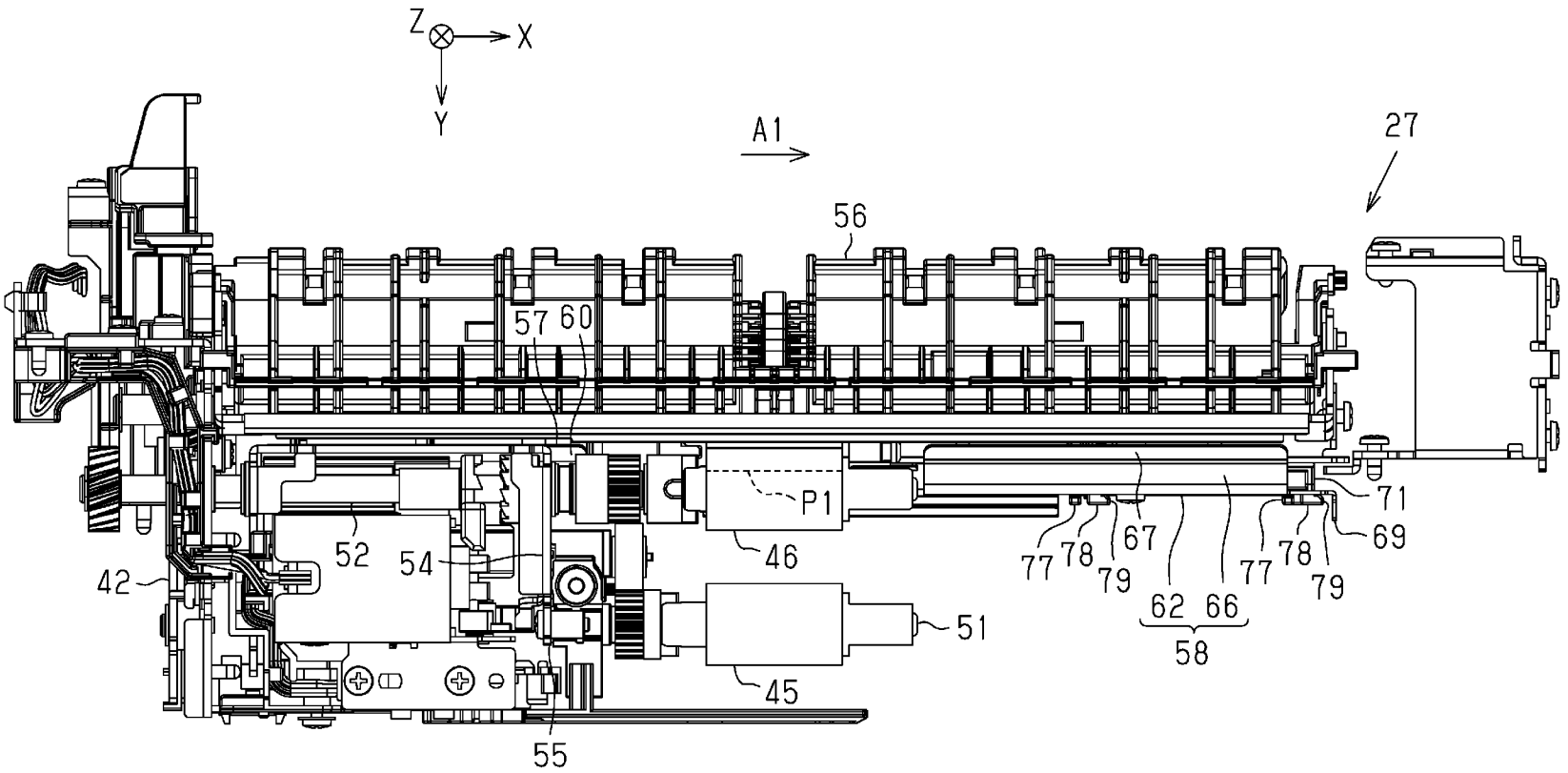
FIG. 9 is a plan view of the transport device.
Figure 10:
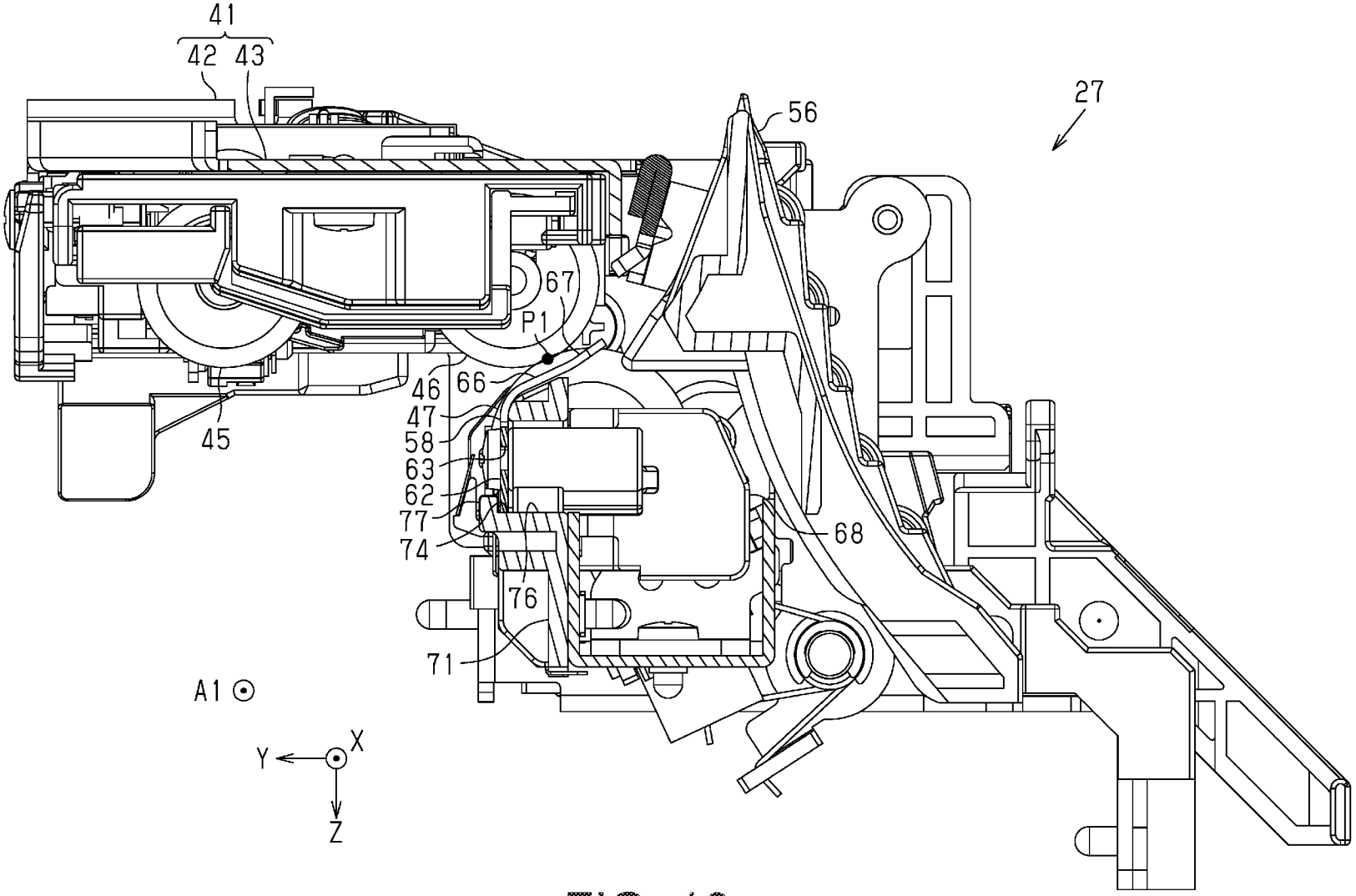
FIG. 10 is a sectional view of the transport device.

As shown in FIGS. 4 and 5, the transport device 27 includes a frame 41. The frame 41 is mounted on the main body 12. The frame 41 is formed of, for example, a sheet metal. Various components of the transport device 27 are mounted on the frame 41. The frame 41 is positioned so as to cover these various components. The frame 41 includes, for example, a base frame 42 and a top frame 43. The base frame 42 and the top frame 43 are fixed to each other. The top frame 43 is positioned so as to cover an upper portion of the transport device 27. An insertion slot 44 may be opened in the top frame 43. The insertion slot 44 is an opening into which a part of a pick holder 54 (to be described later) is inserted.

The transport device 27 includes a plurality of rollers. The transport device 27 includes a pick roller 45. The transport device 27 includes a transport roller 46. The transport device 27 includes a separation roller 47. The pick roller 45, the transport roller 46, and the separation roller 47 transport the medium 99. Each of the pick roller 45, the transport roller 46, and the separation roller 47 extends in the shaft direction A1. Therefore, the pick roller 45, the transport roller 46, and the separation roller 47 transport the medium 99 in a direction different from the shaft direction A1. That is, the transport path 22 extends in a direction different from the shaft direction A1. As an example, the shaft direction A1 extends in the X-axis. Therefore, each of the pick roller 45, the transport roller 46, and the separation roller 47 extend in the X-axis direction.

Each of the pick roller 45, the transport roller 46, and the separation roller 47 has a core portion 48 and a peripheral surface portion 49. The core portion 48 is a portion constituting a core of the roller. The core portion 48 includes a grasping portion 50. The grasping portion 50 is a portion to be held by the user when the roller is attached or detached. The grasping portion 50 extends in the shaft direction A1. The user replaces the roller by holding the grasping portion 50. The peripheral surface portion 49 is a portion constituting the peripheral surface of the roller. Therefore, the peripheral surface portion 49 touches the medium 99. The peripheral surface portion 49 is mounted on the core portion 48 so as to surround the core portion 48. The peripheral surface portion 49 is made of, for example, rubber. In this case, the pick roller 45, the transport roller 46, and the separation roller 47 are rubber rollers.

The pick roller 45 is a roller that contacts the medium 99 stacked on the loading section 15. Specifically, the pick roller 45 contacts the uppermost medium 99 of the plurality of sheets of media 99 stacked on the loading section 15. The pick roller 45 transports the medium 99 from the loading section 15 by rotating. The pick roller 45 transports the medium 99 toward the transport roller 46 and the separation roller 47.

The pick roller 45 is configured to be displaced to a position in contact with the medium 99 stacked on the loading section 15 and a position away from the medium 99 stacked on the loading section 15. The pick roller 45 is, for example, configured to be vertically displaced. When the pick roller 45 is located at a position where the pick roller 45 is in contact with the medium 99 stacked on the loading section 15, the medium 99 can be transported from the loading section 15. When the pick roller 45 is located at a position where it is away from the medium 99 stacked on the loading section 15, the loading section 15 can be pulled out from the main body 12.

The transport roller 46 is a roller that contacts the medium 99 transported by the pick roller 45. The transport roller 46, for example, contacts the medium 99 from above. The transport roller 46 is located downstream of the pick roller 45 in the transport direction. The transport roller 46 transports the medium 99 along the transport path 22. The transport roller 46 transports the medium 99 toward the recording section 33.

The separation roller 47 is a roller that contacts the medium 99 transported by the pick roller 45. The separation roller 47 contacts, for example, the medium 99 from the lower side. The separation roller 47 is positioned downstream of the pick roller 45 in the transport direction. The separation roller 47 faces to the transport roller 46. The transport roller 46 and the separation roller 47 sandwich the medium 99 transported by the pick roller 45.

The separation roller 47 is configured to separate the plurality of sheets of media 99 one by one. The separation roller 47 is configured such that a friction coefficient of the separation roller 47 with respect to medium 99 is larger than a friction coefficient of the transport roller 46 with respect to medium 99. As an example, a torque is applied to the separation roller 47 so as to rotate in a direction in which the medium 99 is returned to the loading section 15. Therefore, when two media 99 enter between the transport roller 46 and the separation roller 47, only one of the two media 99 that is in contact with the transport roller 46 is transported, and another medium 99 that is in contact with the separation roller 47 is returned to the loading section 15. When one sheet of the media 99 enters between the transport roller 46 and the separation roller 47, the separation roller 47 rotates so as to follow the transport roller 46. In this manner, the separation roller 47 separates the media 99 one by one. The separation roller 47 is not limited to a configuration in which torque is applied so as to rotate in a direction in which the medium 99 is returned to the loading section 15, and may be a configuration in which the separation roller 47 is simply driven to rotate so as to follow the transport roller 46.

The separation roller 47 may be configured to be displaced to a position in contact with the transport roller 46 and a position away from the transport roller 46. The separation roller 47 is configured, for example, to be vertically displaced. When the separation roller 47 is separated from the transport roller 46, the separation roller 47 can be easily replaced. The separation roller 47 may be separated from the transport roller 46 by opening the door 14.

The transport device 27 includes a plurality of rotation shafts. The transport device 27 includes a pick shaft 51 which is a rotation shaft of the pick roller 45. The transport device 27 includes a transport shaft 52 which is a rotation shaft of the transport roller 46. The transport device 27 includes a separation shaft 53 which is a rotation shaft of the separation roller 47. A roller is attached to each of the pick shaft 51, the transport shaft 52, and the separation shaft 53. The pick shaft 51, the transport shaft 52, and the separation shaft 53 extend in the shaft direction A1.

The pick roller 45 is detachably mounted on the pick shaft 51. The transport roller 46 is detachably mounted on the transport shaft 52. The separation roller 47 is detachably mounted on the separation shaft 53. When the roller moves in the shaft direction A1, the roller is attachable to and detachable from the rotation shaft. Specifically, the roller is removed from the rotation shaft by moving the roller to the shaft direction A1. The roller is attached to the rotation shaft by moving the roller to the direction opposite to the shaft direction A1. For example, the user can remove the roller from the rotation shaft by pulling the roller in the shaft direction A1 while gripping the grasping portion 50. The user mounts the roller on the rotation shaft by putting the rotation shaft into the roller.

The transport device 27 is configured such that a user can access the pick shaft 51 from upstream in the transport direction. For example, the user can access the pick shaft 51 from the upstream in the transport direction by pulling out the loading section 15 from the main body 12. The user can replace the pick roller 45 by accessing the pick shaft 51.

The transport device 27 is configured such that a user can access the transport shaft 52 from the upstream in the transport direction. For example, the user can access the transport shaft 52 from the upstream in the transport direction by pulling out the loading section 15 from the main body 12. The user can replace the transport roller 46 by accessing the transport shaft 52.

The transport device 27 is configured such that a user can access the separation shaft 53 from the downstream in the transport direction. For example, the user accesses the separation shaft 53 from the downstream in the transport direction by opening the door 14. A user can replace the separation roller 47 by accessing the separation shaft 53. The separation shaft 53 may be displaced away from the transport shaft 52 as the user opens the door 14. As a result, the separation roller 47 is away from the transport roller 46.

The transport device 27 may be configured such that a user can access the pick shaft 51 and the transport shaft 52 from the downstream in the transport direction. The transport device 27 may be configured such that a user can access the separation shaft 53 from the upstream in the transport direction.

The transport device 27 includes a pick holder 54. The pick holder 54 is a holder that can hold the pick roller 45. Specifically, the pick holder 54 is configured to hold the pick shaft 51. The pick holder 54 is mounted on the base frame 42. The pick holder 54 is configured to rotate with respect to the base frame 42. A transport shaft 52, for example, passes through the pick holder 54. The pick holder 54 rotates around the transport shaft 52. As the pick holder 54 rotates, the pick shaft 51 is displaced. That is, when the pick holder 54 rotates, the pick roller 45 is displaced between a position at which it touches the medium 99 stacked on the loading section 15 and a position at which it is away from the medium 99.

The pick holder 54 includes a contacting piece 55. The contacting piece 55 is a portion in contact with the top frame 43. The contacting piece 55 is inserted into the insertion slot 44. When the contacting piece 55 contacts the top frame 43, the top frame 43 can receive a load applied to the pick holder 54. For example, while the pick roller 45 is replaced, a load is applied to the pick holder 54. At this time, there is a risk that the pick holder 54 is deformed. In particular, since the pick holder 54 is configured to rotate, the rigidity of the pick holder 54 tends to be low. In this point, the risk of deformation of the pick holder 54 due to the contacting piece 55 contacting the top frame 43, when the pick roller 45 is replaced, is reduced.

As shown in FIGS. 6, 7, 8, 9, and 10, the transport device 27 includes one or more guide members. As an example, the transport device 27 includes a plurality of guide members. The transport device 27 includes a transport guide member 56. The transport device 27 includes a fixed guide member 57. The transport device 27 includes a movable guide member 58. The guide member is an example of a member that forms the transport path 22. The guide member guides the medium 99 toward the recording section 33.

The transport guide member 56 is a guide member that touches the medium 99 transported by the transport roller 46 and the separation roller 47. Therefore, the transport guide member 56 touches the medium 99 downstream of the nip point P1 between the transport roller 46 and the separation roller 47 in the transport direction. The nip point P1 indicates a position where the transport roller 46 and the separation roller 47 sandwich the medium 99.

The transport guide member 56 is mounted on the base frame 42. The transport guide member 56 is configured to rotate with respect to the base frame 42. The transport guide member 56 is displaced to a position for guiding the medium 99 and a position for exposing the separation roller 47. The transport guide member 56 (shown in FIGS. 6, 7, 9, and 10) is located at a position at which the medium 99 is guided. The transport guide member 56 (shown in FIG. 8) is located at a position where the separation roller 47 is exposed. The transport guide member 56 is positioned to cover the separation roller 47 at a position where the medium 99 is guided.

The transport guide member 56 is interlocked with the door 14. More specifically, the transport guide member 56 is displaced to a position to guide the medium 99 by closing the door 14. The transport guide member 56 is displaced to a position where the separation roller 47 is exposed by opening the door 14. Therefore, the user can easily access the separation shaft 53 by opening the door 14. The transport guide member 56 may be configured to be displaced independently of the door 14.

The fixed guide member 57 and the movable guide member 58 are guide members that touch the medium 99 transported by the pick roller 45. The fixed guide member 57 and the movable guide member 58 guide the medium 99 toward the location between the transport roller 46 and the separation roller 47, that is, to the nip point P1. Therefore, the fixed guide member 57 and the movable guide member 58 touch the medium 99 upstream of the nip point P1 in the transport direction. The fixed guide member 57 and the movable guide member 58 guide the medium 99 to the nip point P1 by contacting the medium 99 from the lower side.

The fixed guide member 57 and the movable guide member 58 are not limited to contacting the medium 99 upstream of the nip point P1 in the transport direction, but they may contact the medium 99 downstream of the nip point P1. That is, the fixed guide member 57 and the movable guide member 58 may guide the medium 99 both upstream and downstream of the nip point P1 in the transport direction. The fixed guide member 57 and the movable guide member 58 may guide the medium 99 to the transport guide member 56, for example, by contacting the medium 99 downstream of the nip point P1. Accordingly, the medium 99 is smoothly transported.

The fixed guide member 57 and the movable guide member 58 are aligned with the separation roller 47 in the shaft direction A1. Specifically, the fixed guide member 57 is located at a position deviated from the separation roller 47 in the direction opposite to the shaft direction A1. The movable guide member 58 is located at a position that deviates from the separation roller 47 in the shaft direction A1. That is, the fixed guide member 57 is arranged opposite to the movable guide member 58 with respect to the separation roller 47 in the shaft direction A1. Therefore, the fixed guide member 57, the separation roller 47, and the movable guide member 58 are arranged in this order in the shaft direction A1.

The fixed guide member 57 is mounted on the base frame 42. The fixed guide member 57 is fixed to the base frame 42. The fixed guide member 57 is, for example, a plate-shape member.

The fixed guide member 57 has a fixed mounting portion 59. The fixed mounting portion 59 is a portion to be mounted on the base frame 42. As an example, the fixed mounting portion 59 is located at a lower portion of the fixed guide member 57. The fixed mounting portion 59 is located, for example, upstream of the nip point P1 in the transport direction.

The fixed guide member 57 includes a fixed guide portion 60. The fixed guide portion 60 is a portion for guiding the medium 99 by contacting the medium 99. As an example, the fixed guide portion 60 is located at the upper portion of the fixed guide member 57. The fixed guide portion 60 extends from the fixed mounting portion 59 in the transport direction. The fixed guide portion 60 may extend downstream of the nip point P1 in the transport direction. Thus, the fixed guide member 57 can guide the medium 99 to the transport guide member 56 at a position downstream of the nip point P1 in the transport direction.

The fixed guide portion 60 includes a fixed guide face 61. The fixed guide face 61 is a surface that touches the medium 99 in the fixed guide portion 60. The fixed guide face 61 touched the medium 99 from the lower side. The fixed guide face 61 is located upstream of the nip point P1 in the transport direction. Accordingly, the fixed guide member 57 can guide the medium 99 to the nip point P1. As an example, the fixed guide face 61 extends from a position upstream of the nip point P1 to a position downstream of the nip point P1 in the transport direction.

The movable guide member 58 is mounted on the base frame 42. Specifically, the movable guide member 58 is mounted on a holding member 71 (to be described later). The movable guide member 58 is, for example, a plate-shape member.

The movable guide member 58 is configured to move in the shaft direction A1. Specifically, the movable guide member 58 is movable in the shaft direction A1 with respect to the base frame 42. The movable guide member 58 is slidable in the shaft direction A1.

The movable guide member 58 is displaced between the guide position and the retracted position by moving in the shaft direction A1. Specifically, the movable guide member 58 is displaced from the guide position to the retracted position by moving in the shaft direction A1. The movable guide member 58 moves from the retracted position to the guide position by moving in the direction opposite to the shaft direction A1. The movable guide member 58 (shown in FIGS. 6, 7, 8, and 9) is positioned at the guide position.

The movable guide member 58 guides the medium 99 at the guide position. At this time, the movable guide member 58 is adjacent to the separation roller 47 in the shaft direction A1. Therefore, at the guide position, the movable guide member 58 restricts the separation roller 47 from moving in the shaft direction A1. That is, when the movable guide member 58 is located at the guide position, the separation roller 47 is prevented from being detached from the separation shaft 53. Therefore, when the separation roller 47 is replaced, the movable guide member 58 is displaced to the retracted position. The retracted position will be described later.

The movable guide member 58 is positioned so as not to overlap the separation roller 47 in the shaft direction A1. That is, the position of the movable guide member 58 in the shaft direction A1 does not overlap with the position of the separation roller 47 in the shaft direction A1. As an example, the movable guide member 58 does not overlap with the grasping portion 50 of the separation roller 47 in the shaft direction A1. Thus, when the movable guide member 58 moves in the shaft direction A1, the risk of interference with the separation roller 47 is reduced.

The movable guide member 58 may be positioned so as to overlap the separation roller 47 in the shaft direction A1. More specifically, the position of the movable guide member 58 in the shaft direction A1 may overlap the position of the separation roller 47 in the shaft direction A1. In this case, the movable guide member 58 should be configured to extend between the nip point P1 and the grasping portion 50 when viewed from the shaft direction A1.

The movable guide member 58 includes a movable mounted portion 62. The movable mounted portion 62 is the portion that is mounted to the base frame 42. Specifically, the movable mounted portion 62 is a portion mounted on the holding member 71. The movable mounted portion 62 is mounted on the base frame 42 by being mounted on the holding member 71. As an example, the movable mounted portion 62 is located at a lower portion of the movable guide member 58. The movable mounted portion 62 is located, for example, upstream of the nip point P1 in the transport direction.

The movable mounted portion 62 is mounted on the holding member 71 so as to be movable in the shaft direction A1. The movable mounted portion 62 moves in the shaft direction A1 with respect to the holding member 71. One or more insertion holes 63 are opened on the movable mounted portion 62. As an example, the movable mounted portion 62 is provided with two insertion holes 63. Two insertion holes 63 are arranged in the shaft direction A1. The insertion hole 63 is an elongated hole extending in the shaft direction A1. The movable guide member 58 is guided in the shaft direction A1 by the insertion hole 63.

A part of the holding member 71 is inserted into the insertion hole 63. In detail, a protrusion 78 (to be described later) is inserted into the insertion hole 63. Thus, the movable mounted portion 62 is guided by the holding member 71.

Figure 11:
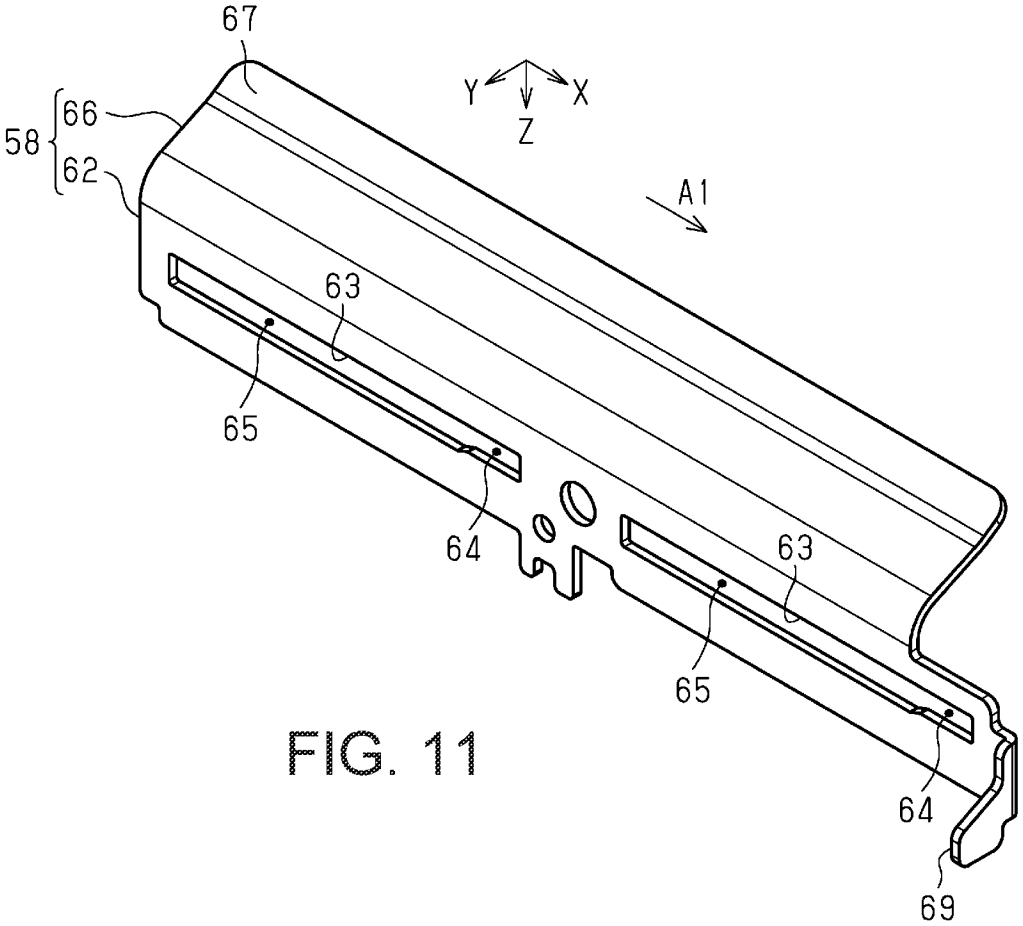
FIG. 11 is a perspective view of the movable guide member.
Figure 12:
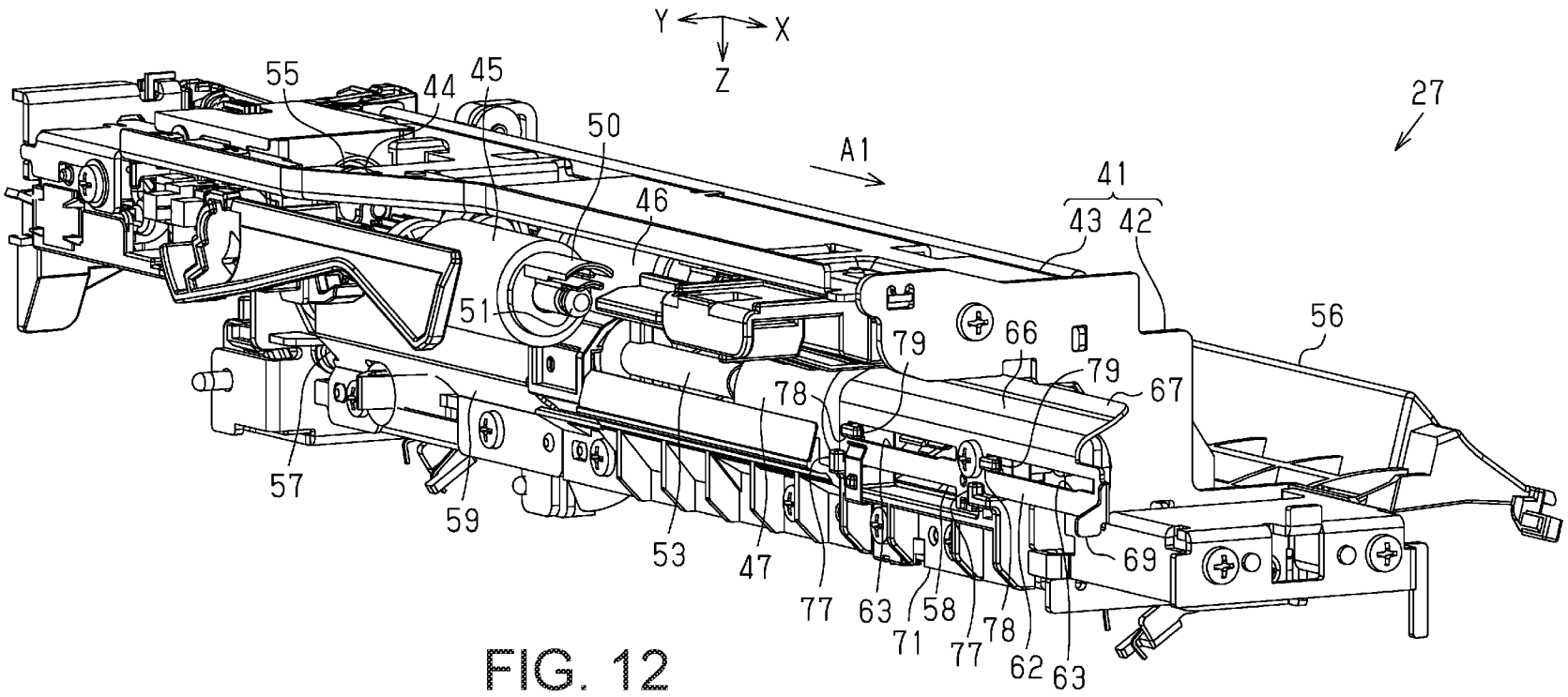
FIG. 12 is a perspective view of a state in which the movable guide member is displaced to the retracted position from FIG. 6.
Figure 13:
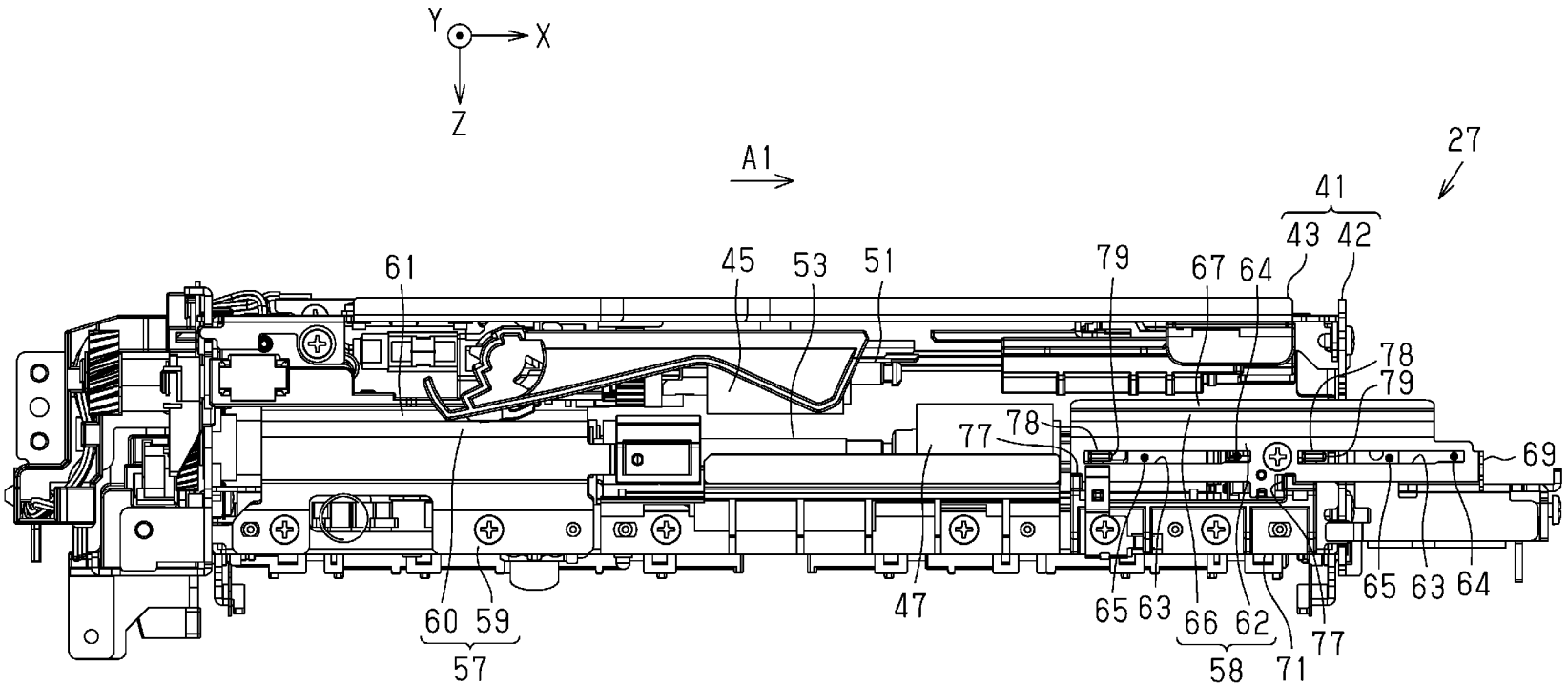
FIG. 13 is a front view of a state in which the movable guide member is displaced to the retracted position from FIG. 7.
Figure 14:
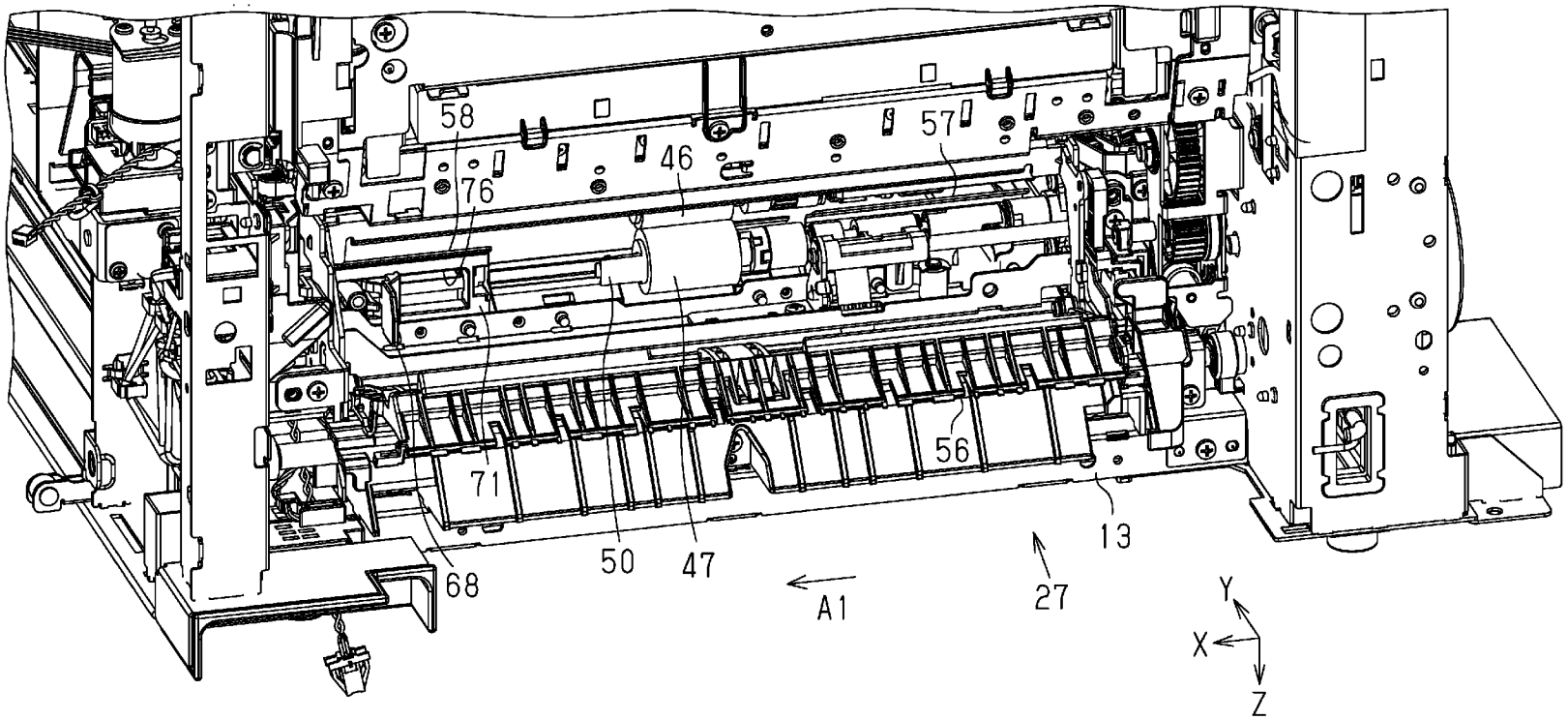
FIG. 14 is a perspective view of a state in which the movable guide member is displaced to the retracted position from FIG. 8.
Figure 15:
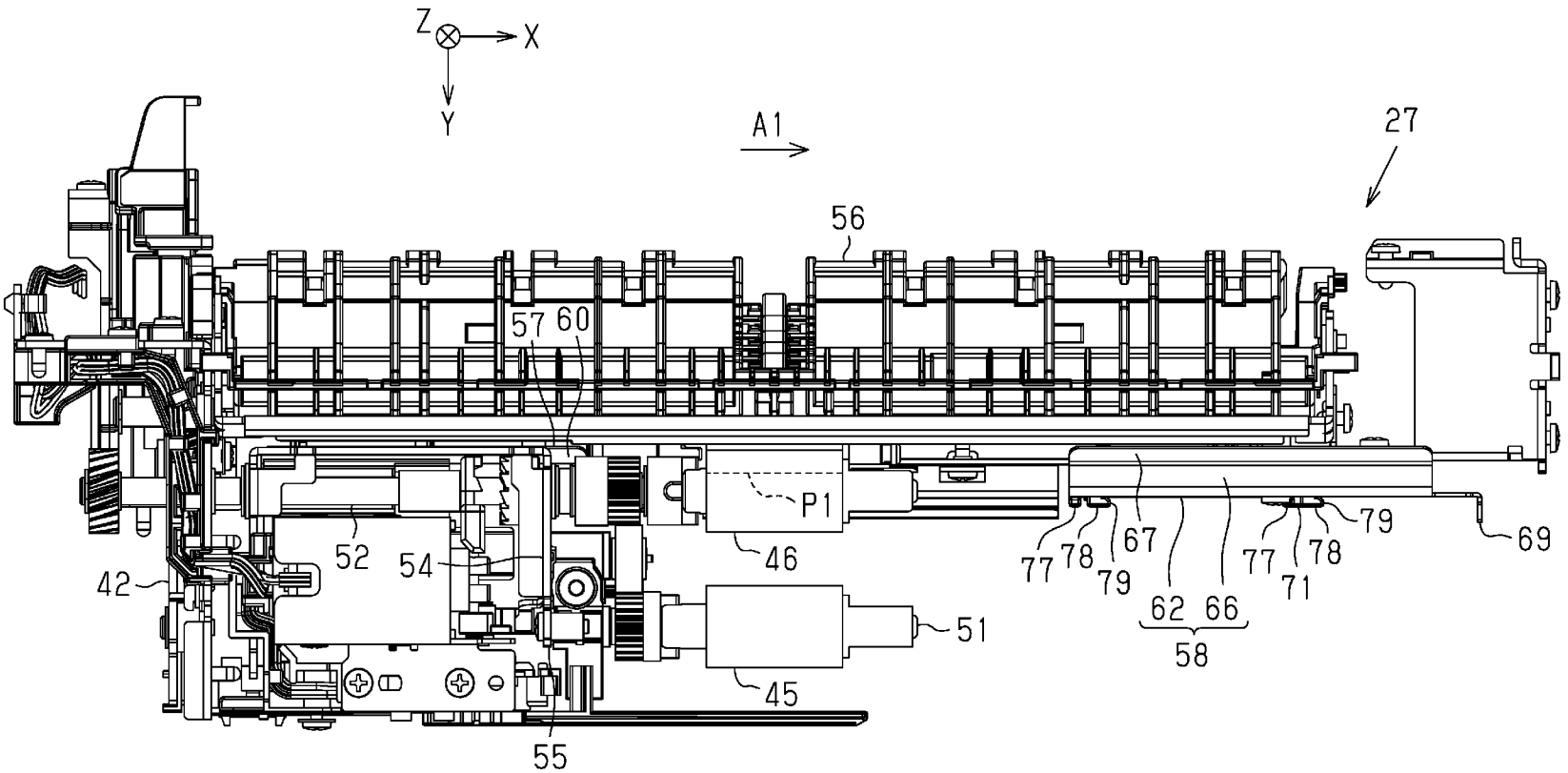
FIG. 15 is a plan view of a state in which the movable guide member is displaced to the retracted position from FIG. 9.

As shown in FIG. 11, the insertion hole 63 includes a guide area 64 and a retraction area 65. The guide area 64 is an area where the protrusion 78 is located in the insertion hole 63 when the movable guide member 58 is located at the guide position. The retraction area 65 is an area where the protrusion 78 is positioned in the insertion hole 63 when the movable guide member 58 retracts from the guide position. That is, the retraction area 65 is an area in which the protrusion 78 moves when the movable guide member 58 moves from the guide position to the retracted position and when the movable guide member 58 moves from the retracted position to the guide position. The retraction area 65 includes an area where the protrusion 78 is located in the insertion hole 63 while the movable guide member 58 is located at the retracted position. The guide area 64 is located at the end of the insertion hole 63. The guide area 64 is located at a position offset from the retraction area 65 in the shaft direction A1. In the shaft direction A1, the length of the guide area 64 is smaller than the length of the retraction area 65.

The insertion hole 63 extends in the shaft direction A1 so that the width of the insertion hole 63 changes. As an example, the width of the insertion hole 63 is the length of the insertion hole 63 in the vertical direction. The width of the guide area 64 and the width of the retraction area 65 are different from each other. The width of the guide area 64 is narrower than the width of the retraction area 65. Because the width of the guide area 64 is narrow, the movable guide member 58 is positioned with respect to the holding member 71. Because the width of the retraction area 65 is wide, the movable guide member 58 is easily moved in the shaft direction A1.

As shown in FIGS. 6, 7, 8, 9, 10 and 11, the movable guide member 58 has a movable guide portion 66. The movable guide portion 66 contacts the medium 99 and guides the medium 99. As an example, the movable guide portion 66 is located at the upper portion of the movable guide member 58. The movable guide portion 66 extends from the movable mounted portion 62 in the transport direction.

The movable guide portion 66 may extend downstream of the nip point P1 in the transport direction. That is, the movable guide portion 66 may extend upstream and downstream in the transport direction with respect to the nip point P1 when viewed from the shaft direction A1. As a result, the movable guide member 58 can guide the medium 99 to the transport guide member 56 downstream of the nip point P1 in the transport direction.

In the transport direction, the downstream end of the movable guide portion 66 may overlap the transport guide member 56. Thus, the movable guide member 58 can guide the medium 99 to the transport guide member 56. When the downstream end of the movable guide portion 66 does not overlap the transport guide member 56, there is a risk that the medium 99 enters the gap between the separation roller 47 and the transport guide member 56.

The movable guide portion 66 extends so as to overlap the fixed guide portion 60 when viewed from the shaft direction A1. That is, the movable guide portion 66 is located at the same height as the fixed guide portion 60. Thus, the fixed guide member 57 and the movable guide member 58 can easily guide the medium 99 to the nip point P1.

The movable guide portion 66 has a movable guide face 67. The movable guide face 67 is a surface that contacts the medium 99 in the movable guide portion 66. The movable guide face 67 contacts the medium 99 from the lower side. The movable guide face 67 is located upstream of the nip point P1 in the transport direction. Accordingly, the movable guide member 58 can guide the medium 99 to the nip point P1. The movable guide face 67 may extend upstream and downstream in the transport direction with respect to the nip point P1 when viewed from the shaft direction A1.

The movable guide face 67 overlaps with the fixed guide face 61 when viewed from the shaft direction A1. That is, the movable guide face 67 is positioned at the same height as the fixed guide face 61. The position of the movable guide face 67 in the vertical direction coincides with the position of the fixed guide face 61 in the vertical direction.

The user operation displaces the movable guide member 58. The movable guide member 58 has a grip member 68. The grip member 68 is gripped when the user moves the movable guide member 58. As an example, the grip member 68 is mounted on the movable mounted portion 62. In the movable guide member 58, the grip member 68 is located to be accessible from downstream in the transport direction. The grip member 68 is exposed by opening the door 14. More specifically, the grip member 68 is exposed together with the separation roller 47 when the transport guide member 56 rotates as the door 14 is opened.

As shown in FIGS. 12, 13, 14, and 15, the movable guide member 58 is located at the retracted position. At the retracted position, the movable guide member 58 is retracted from a position adjacent to the separation roller 47 in the shaft direction A1. When the movable guide member 58 is located at the retracted position, the separation roller 47 can move from the separation shaft 53 in the shaft direction A1. That is, the movable guide member 58 does not prevent the mounting and demounting of the separation roller 47 at the retracted position. Therefore, when the movable guide member 58 retracts, a space is generated in which the separation roller 47 can be mounted and demounted on the separation shaft 53. As a result, the separation roller 47 can be mounted and demounted on the separation shaft 53.

In the case where the movable guide member 58 slides in the shaft direction A1, the space in which the movable guide member 58 retreats for replacement of the separation roller 47 may be smaller than that in the case where the movable guide member 58 rotates about the shaft direction A1. In the transport device 27 and the recording device 11, since the medium 99 having widths in the shaft direction A1 is transported, it is easy to secure a space for the movable guide member 58 to retreat in the shaft direction A1.

The movable guide member 58 is positioned in the body frame 13 at the retracted position. That is, even when the movable guide member 58 is displaced from the guide position to the retracted position, it does not protrude from the body frame 13. The movable guide member 58 is housed in the body frame 13 at the guide position and the retracted position. When the movable guide member 58 protrudes from the body frame 13, there is a risk that an article positioned around the recording device 11 collides with the movable guide member 58 or a user collides with the movable guide member 58. In this case, the movable guide member 58 may be damaged. By housing the movable guide member 58 in the body frame 13, the movable guide member 58 is protected.

The movable guide member 58 may include a pressing portion 69. The pressing portion 69 is a section to be pressed against the loading section 15. As an example, the pressing portion 69 comprises a portion of the movable mounted portion 62. The pressing portion 69 is located at the end of the movable mounted portion 62.

Figure 16:
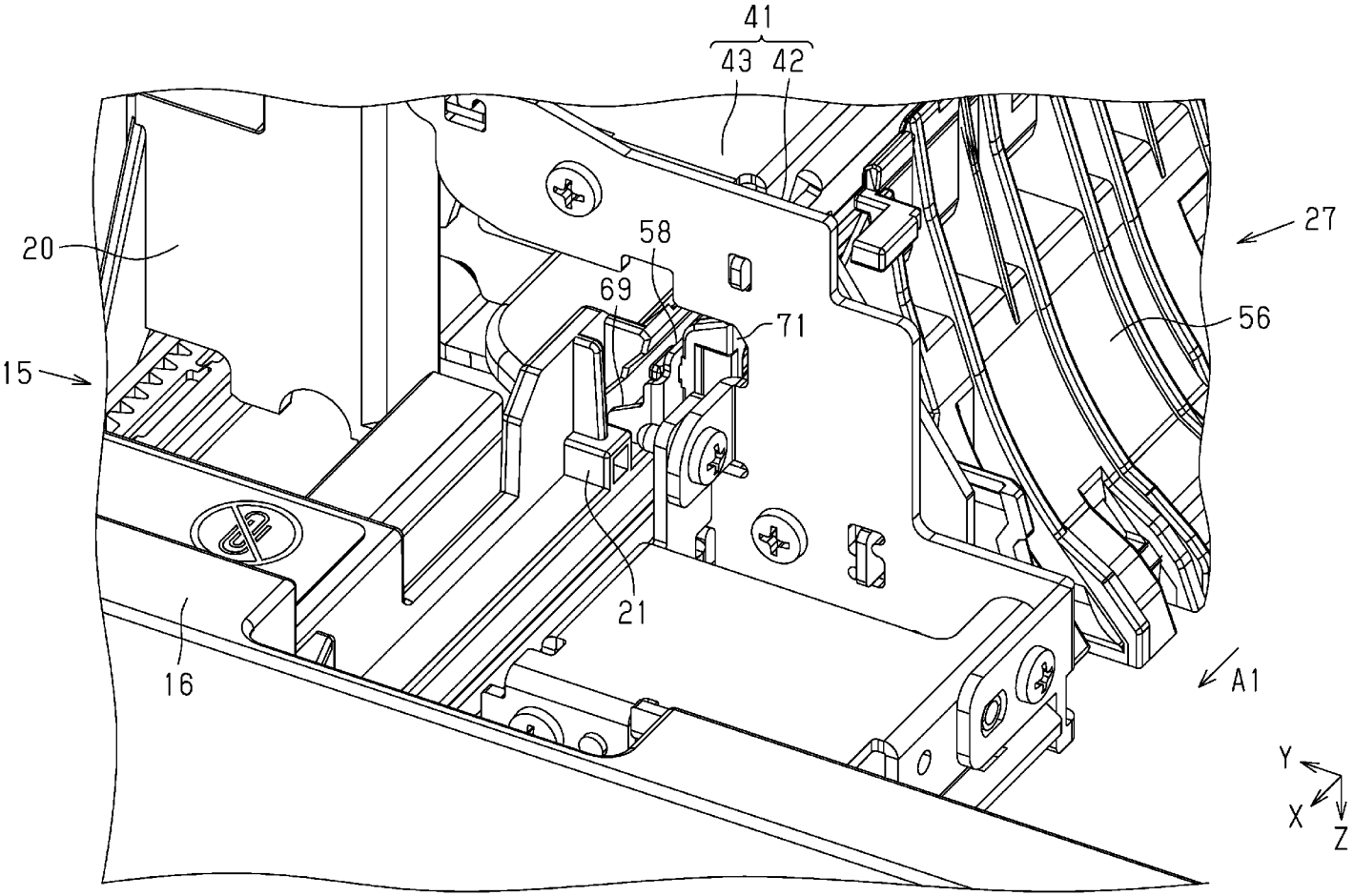
FIG. 16 is an enlarged view of FIG. 3.

As shown in FIG. 16, the pressing portion 69 contacts the contact member 21. Specifically, the pressing portion 69 is pressed by the contact member 21 when the loading section 15 is inserted into the main body 12 in a state where the movable guide member 58 is located at the retracted position. As a result, the movable guide member 58 is displaced from the retracted position to the guide position. That is, by inserting the loading section 15, the movable guide member 58 is displaced to the guide position. Accordingly, in a state in which the movable guide member 58 is positioned at the retracted position, a risk that the medium 99 is transported from the loading section 15 is reduced.

As shown in FIGS. 6, 7, 12, and 13, the transport device 27 includes a holding member 71. The holding member 71 is mounted on the base frame 42. The holding member 71 is fixed to the base frame 42. The holding member 71 holds the movable guide member 58. Specifically, the holding member 71 holds the movable guide member 58 so as to be movable in the shaft direction A1.

Figure 17:
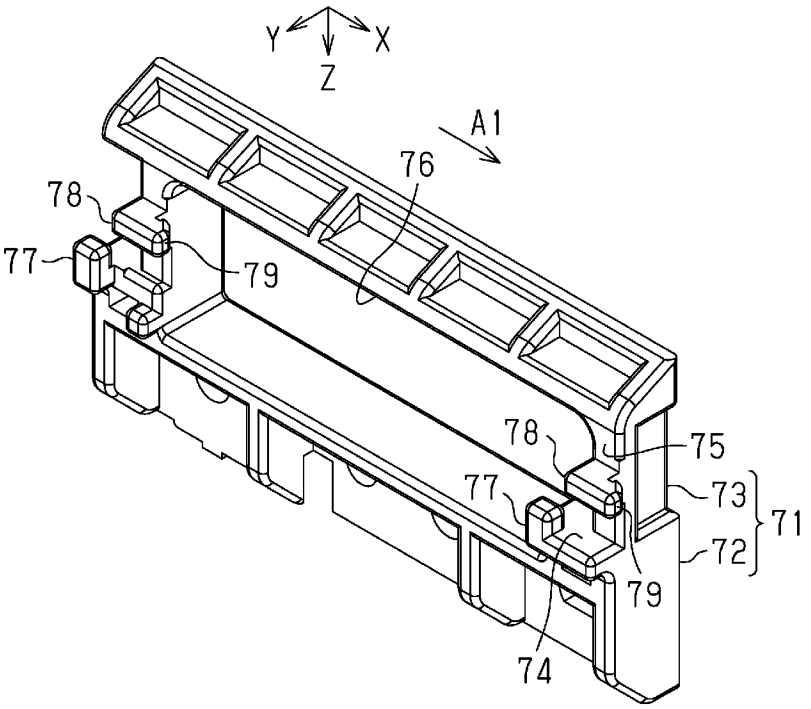
FIG. 17 is a perspective view of the holding member.

As shown in FIG. 17, the holding member 71 includes a fixed portion 72 and a holding portion 73. The fixed portion 72 is a portion fixed to the base frame 42. As an example, the fixed portion 72 is located in the lower portion of the holding member 71. The holding portion 73 is a portion for holding the movable guide member 58. As an example, the holding portion 73 is located in upper position of the holding member 71.

The holding portion 73 includes a support face 74. The support face 74 is a surface that supports the movable guide member 58. The support face 74 receives a load from the movable guide member 58 by contacting the movable guide member 58. As an example, the support face 74 contacts an end of the movable mounted portion 62. The support face 74 is, for example, a surface facing upward.

The holding portion 73 has a opposing face 75. The opposing face 75 is a surface facing the movable guide member 58. As an example, the opposing face 75 faces the movable mounted portion 62. The opposing face 75 is, for example, a surface facing upstream in the transport direction. The opposing face 75 extends from the support face 74 along the movable mounted portion 62. The opposing face 75 extends upward from the support face 74. The opposing face 75 supports a movable mounted portion 62. Thus, the posture of the movable guide member 58 is stabilized.

A through hole 76 is opened in the holding portion 73. The through hole 76 is opened in the opposing face 75. A grip member 68 is mounted on the movable mounted portion 62 through the through hole 76.

The holding member 71 has one or more convex portions 77. As an example, the holding member 71 has two convex portions 77. Two convex portions 77 are spaced apart from each other in the shaft direction A1. The convex portion 77 protrudes from the support face 74. The convex portion 77 protrudes upward from the support face 74. The convex portion 77 reduces a risk that the movable guide member 58 falls off from the holding member 71. The holding member 71 sandwiches the movable mounted portion 62 using the convex portion 77 and the opposing face 75. Thus, the holding member 71 holds the movable guide member 58. Since the holding member 71 holds the movable guide member 58 by the plurality of convex portions 77, the movable guide member 58 is less likely to fall off.

The holding member 71 includes one or more protrusions 78. As an example, the holding member 71 includes two protrusions 78. Two protrusions 78 are spaced apart from each other in the shaft direction A1. The protrusion 78 protrudes from the opposing face 75. The protrusion 78 protrudes from the opposing face 75 toward the upstream in the transport direction. The protrusion 78 is inserted into the insertion hole 63. The protrusion 78 guides the movement of the movable guide member 58.

The protrusion 78 moves in the insertion hole 63 by displacing the movable guide member 58. The protrusion 78 is located in the guide area 64 when the movable guide member 58 is located at the guide position. The protrusion 78 is located in the retraction area 65 when the movable guide member 58 is located at the retracted position.

The holding member 71 is configured to position the movable guide member 58 located at the guide position. When the movable guide member 58 moves in the shaft direction A1, there is a risk that its position in the vertical direction is shifted. That is, when the movable guide member 58 moves to the shaft direction A1, there is a risk that the height of the movable guide member 58 is shifted. Therefore, the holding member 71 aligns with the movable guide member 58.

The holding member 71 aligns with the movable guide member 58 located at the guide position by the protrusion 78. The width of the protrusion 78 is approximately the same as the width of the guide area 64. The width of the protrusion 78 is the length of the protrusion 78 in the vertical direction. Therefore, when the protrusion 78 is located in the guide area 64, it is fitted into the insertion hole 63. Thus, the movable guide member 58 is aligned with respect to the protrusion 78. Therefore, the risk that the height of the movable guide member 58 located at the guide position deviates from that of the fixed guide member 57 is reduced. On the other hand, because the width of the protrusion 78 is smaller than the width of the retraction area 65, the protrusion 78 does not fit into the insertion hole 63 when the protrusion 78 is positioned in the retraction area 65. Therefore, the protrusion 78 can smoothly move in the retraction area 65. Thus, the movable guide member 58 can be smoothly moved in the shaft direction A1.

The holding member 71 is not limited to varying the width of the insertion hole 63, and the movable guide member 58 may be positioned in other configurations. For example, the holding member 71 may include a spring that presses the movable guide member 58 upward. In this case, the protrusion 78 continues to be in contact with the upper edge of the insertion hole 63. Therefore, the risk that the position of the movable guide member 58 is displaced is reduced. Further, the holding member 71 may include a pin which is fitted to the movable guide member 58 located at the guide position.

The holding member 71 may align with the movable guide member 58 by contacting the movable guide member 58 at a plurality of positions. As an example, as described above, the holding member 71 aligns with the movable guide member 58 by the two protrusions 78 contacting the movable guide member 58. In a case where the holding member 71 is aligned by contacting the movable guide member 58 at a plurality of positions, the posture of the movable guide member 58 is easily stabilized compared to a case where the holding member 71 is positioned by contacting the movable guide member 58 at one position. For example, in a case where the holding member 71 is aligned by contacting the movable guide member 58 at one place, there is a risk that the movable guide member 58 may rotate around the place.

The protrusion 78 may include a hook 79. The hook 79 is located at the tip end of the protrusion 78. The hook 79 extends, for example, in the shaft direction A1. In the shaft direction A1, the hook 79 overlaps the movable mounted portion 62 when the protrusion 78 is located in the guide area 64. That is, when the movable guide member 58 is located at the guide position, it is located between the hook 79 and the opposing face 75. Thus, the risk that the protrusion 78 comes off from the insertion hole 63 is reduced.

Replacement Procedure of Separation Roller

Next, a procedure for replacing the separation roller 47 will be described.

First, the user opens the door 14. Next, the user moves the movable guide member 58 to the retracted position. Next, the user removes the separation roller 47 from the separation shaft 53 by pulling the grasping portion 50. Next, the user mounts the separation roller 47 on the separation shaft 53 by putting the separation shaft 53 into a new separation roller 47. Next, the user moves the movable guide member 58 to the guide position. The user then closes the door 14. In this way, the separation roller 47 is replaced.

Operation and Effect

Next, the operation and effects of the above embodiment will be described.

1. When the movable guide member 58 moves in the shaft direction A1, it is displaced to a guide position for guiding the medium 99 and a retracted position where the separation roller 47 can move in the shaft direction A1 with respect to the separation shaft 53.

When the movable guide member 58 is displaced to the retracted position, the separation roller 47 can be detached from and attached to the separation shaft 53. When the movable guide member 58 is displaced to the retracted position by moving in the shaft direction A1, the area required for the movement of the movable guide member 58 is narrower than that required when the movable guide member 58 is displaced to the retracted position by rotating. Therefore, according to the above configuration, the risk of an increase in the size of the apparatus is reduced compared with that in which the movable guide member 58 is displaced to the retracted position by rotating.

2. When viewed from the shaft direction A1, the movable guide face 67 extends upstream and downstream in the transport direction with respect to the nip point P1, where the transport roller 46 and the separation roller 47 sandwich the medium 99. According to the above-described configuration, the movable guide member 58 can guide the separated medium 99 in addition to guiding the medium 99 to the nip point P1.
3. The movable guide face 67 is positioned at the same height as the fixed guide face 61.

According to the above-described configuration, the medium 99 can be accurately guided by the movable guide member 58 and the fixed guide member 57.

4. The holding member 71 aligns with the movable guide member 58 located at the guide position.

According to the above configuration, the movable guide member 58 can accurately guide the medium 99 at the guide position.

5. In the width of the insertion hole 63, a region where the protrusion 78 is located when the movable guide member 58 is located at the guide position is narrower than a region where the protrusion 78 is located when the movable guide member 58 is located at the retracted position.

According to the above-described configuration, when the movable guide member 58 is located at the guide position, the protrusion 78 is less likely to move in the insertion hole 63 than when the movable guide member 58 is located at the retracted position. Thus, the movable guide member 58 is aligned with respect to the holding member 71 at the guide position. Therefore, the movable guide member 58 can accurately guide the medium 99 at the guide position.

6. The holding member 71 aligns with the movable guide member 58 by contacting the movable guide member 58 at a plurality of positions.

When the movable guide member 58 is aligned by contacting the holding member 71 at one position, there is a risk that the posture of the movable guide member 58 is unstable. In this regard, according to the above-described configuration, because the movable guide member 58 is aligned by contacting the holding member 71 at a plurality of positions, the posture of the movable guide member 58 is easily stabilized.

7. The grasping portion 50 of the separation roller 47 is positioned so as not to overlap the movable guide member 58 positioned at the guide position in the shaft direction A1.

According to the above configuration, the risk that the movable guide member 58 interferes with the grasping portion 50 is reduced.

8. The transport guide member 56 is interlocked with the door 14, and exposes the separation roller 47 when the door 14 is opened.

According to the above configuration, the user can access the separation roller 47 by opening the door 14 without separately displacing the transport guide member 56. Therefore, it is easy for the user to replace the separation roller 47.

9. The grip member 68 is exposed when the door 14 is opened.

According to the above configuration, the user can access the grip member 68 by opening the door 14. The user can displace the movable guide member 58 by grasping the grip member 68. Therefore, it is easy for the user to replace the separation roller 47.

10. The movable guide member 58 is positioned in the body frame 13 at the retracted position.

According to the above configuration, the risk of damage to the movable guide member 58 is reduced.

11. When the loading section 15 is inserted into the main body 12, it contacts the movable guide member 58 located at the retracted position to displace the movable guide member 58 to the guide position.

According to the above-described configuration, in a state where the movable guide member 58 is located at the retracted position, the risk that the medium 99 is transported from the loading section 15 is reduced.

Modifications

The above-described embodiment may be modified as follows. The above-described embodiments and the following modifications can be implemented in combination within a range that is not technically contradictory.

The liquid ejected by the recording section 33 is not limited to ink and may be, for example, a liquid material in which particles of a functional material are dispersed or mixed in a liquid. For example, the recording section 33 may eject a liquid material containing a material such as an electrode material or a pixel material used for manufacturing a liquid crystal display, an electroluminescence display, a surface emitting display, or the like in a dispersed or dissolved form.

Technical Ideas

Hereinafter, technical ideas derived from the above embodiments and modifications, and operations and effects thereof, will be described.

Aspect 1: A transport device configured to transport medium stacked on a loading section, the transport device includes a transport roller configured to transport a medium, a separation roller opposed to the transport roller and separating the medium one by one, a rotation shaft to which is attached the separation roller, and a movable guide member configured to guide a medium between the transport roller and the separation roller, to be arranged with the separation roller in a shaft direction of the rotation shaft, and to be movable in the shaft direction wherein the separation roller is attachable to and detachable from the rotation shaft by moving in the shaft direction, and the movable guide member moves in the shaft direction to be displaced between a guide position at which the medium is guided and a retracted position at which the separation roller is movable in the shaft direction with respect to the rotation shaft.

When the movable guide member is displaced to the retracted position, the separation roller can be attached to and detached from the rotation shaft. When the movable guide member is displaced to the retracted position by moving in the shaft direction, the area required for the movement of the movable guide member is narrower than that required when the movable guide member is displaced to the retracted position by rotating. Therefore, according to the above-described configuration, compared with a configuration in which the movable guide member is displaced to the retracted position by rotation, the risk of the apparatus being enlarged is reduced.

Aspect 2: In the transport device, according to aspect 1, the movable guide member may include a movable guide face configured to guide the medium by coming into contact with the medium, and the movable guide face may extend upstream and downstream in a transport direction in which the medium is transported with reference to a nip point at which the transport roller and the separation roller nip the medium when viewed from the shaft direction. According to the above-described configuration, the movable guide member can guide the medium after separation in addition to guiding the medium to the nip point.

Aspect 3: The transport device, according to aspects 1 and 2, further includes a fixed guide member arranged opposite to the movable guide member with respect to the separation roller in the shaft direction and configured to guide the medium wherein the fixed guide member has a fixed guide face for guiding the medium by contacting the medium, the movable guide member has a movable guide face for guiding the medium by contacting the medium, and the movable guide face may be located at the same height as the fixed guide face. According to the above configuration, the medium can be accurately guided by the movable guide member and the fixed guide member.

Aspect 4: The transport device, according to aspect 1, further includes a holding member configured to hold the movable guide member wherein the holding member may set the position of the movable guide member located at the guide position. According to the above configuration, the movable guide member can accurately guide the medium at the guide position.

Aspect 5: In the transport device, according to aspect 4, the holding member includes a protrusion to be inserted into the movable guide member, an insertion hole into which the protrusion is inserted is opened in the movable guide member, the insertion hole extends in the shaft direction, and the width of the insertion hole is such that a region where the protrusion is located when the movable guide member is located at the guide position may be smaller than a region where the protrusion is located when the movable guide member is located at the retracted position.

According to the above-described configuration, when the movable guide member is located at the guide position, the protrusion is less likely to move in the insertion hole than when the movable guide member is located at the retracted position. Thus, the movable guide member is aligned with respect to the holding member at the guide position. Therefore, the movable guide member can accurately guide the medium at the guide position.

Aspect 6: In the transport device, according to aspects 4 or 5, the holding member may contact the movable guide member at a plurality of locations and set the position of the movable guide member.

When the movable guide member is positioned by contacting the holding member at one position, the posture of the movable guide member may be unstable. In this regard, according to the above-described configuration, because the movable guide member is positioned by contacting the holding member at a plurality of positions, the posture of the movable guide member is easily stabilized.

Aspect 7: In the transport device, according to aspect 1, the separation roller may include a grasping portion configured to be grasped by a user when the separation roller is attached to and detached from the rotation shaft, and the grasping portion may extend in the shaft direction and is positioned to not overlap the movable guide member located in the guide position in the shaft direction. According to the above configuration, a risk that the movable guide member interferes with the grasping portion is reduced.

Aspect 8: A recording device includes a loading section configured to stack a medium, a transport roller configured to transport the medium stacked on the loading section, a recording section configured to record an image on a medium transported by the transport roller, a separation roller opposed to the transport roller and separating the medium one by one, a rotation shaft to which is attached the separation roller, and a movable guide member configured to guide a medium between the transport roller and the separation roller, to be arranged with the separation roller in a shaft direction of the rotation shaft, and to be movable in the shaft direction wherein the separation roller is attachable to and detachable from the rotation shaft by moving in the shaft direction, and the movable guide member moves in the shaft direction to be displaced between a guide position at which the medium is guided and a retracted position at which the separation roller is movable in the shaft direction with respect to the rotation shaft. According to the above configuration, it is possible to obtain an effect similar to that of the above-described transport device.

Aspect 9: In the recording device, according to aspect 8, the movable guide member may include a movable guide face configured to guide the medium by coming into contact with the medium, and the movable guide face extends upstream and downstream in a transport direction in which the medium is transported with reference to a nip point at which the transport roller and the separation roller nip the medium when viewed from the shaft direction. According to the above configuration, it is possible to obtain an effect similar to that of the above-described transport device.

Aspect 10: The recording device, according to aspect 8 or 9, further includes a fixed guide member arranged opposite to the movable guide member with respect to the separation roller in the shaft direction and configured to guide the medium wherein the fixed guide member has a fixed guide face for guiding the medium by contacting the medium, the movable guide member has a movable guide face for guiding the medium by contacting the medium, and the movable guide face may be located at the same height as the fixed guide face. According to the above configuration, it is possible to obtain an effect similar to that of the above-described transport device.

Aspect 11: The recording device, according to aspect 8, further includes a holding member configured to hold the movable guide member wherein the holding member may set the position of the movable guide member located at the guide position. According to the above configuration, it is possible to obtain an effect similar to that of the above-described transport device.

Aspect 12: In the recording device, according to aspect 11, the holding member includes a protrusion to be inserted into the movable guide member, an insertion hole into which the protrusion is inserted is opened in the movable guide member, the insertion hole extends in the shaft direction, and the width of the insertion hole is such that a region where the protrusion is located when the movable guide member is located at the guide position may be smaller than a region where the protrusion is located when the movable guide member is located at the retracted position. According to the above configuration, it is possible to obtain an effect similar to that of the above-described transport device.

Aspect 13: In the recording device, according to aspects 11 or 12, the holding member contacts the movable guide member at a plurality of locations and may set the position of the movable guide member. According to the above configuration, it is possible to obtain an effect similar to that of the above-described transport device.

Aspect 14: In the recording device, according to aspect 8, the separation roller includes a grasping portion configured to be grasped by a user when the separation roller is attached to and detached from the rotation shaft, and the grasping portion may extend in the shaft direction and be positioned to not overlap the movable guide member located in the guide position in the shaft direction. According to the above configuration, it is possible to obtain an effect similar to that of the above-described transport device.

Aspect 15: The recording device, according to aspect 8, further includes a main body, a door configured to open and closed with respect to the main body, and a transport guide member configured to guide the medium transported by the transport roller toward the recording section wherein the transport guide member is interlocked with the door and may expose the separation roller by opening the door.

According to the above configuration, the user can the separation roller by opening the door without displacing separately the transport guide member. Therefore, it is easy for the user to replace the separation roller.

Aspect 16: In the recording device, according to aspect 15, the movable guide member includes a grip member to be grasped by a user, and the grip member may be exposed by opening the door. According to the above configuration, the user can access the grip member by opening the door. The user can displace the movable guide member by gripping the grip member. Therefore, it is easy for the user to replace the separation roller.

Aspect 17: The recording device, according to aspect 8, further includes a body frame wherein the movable guide member may be arranged inside the body frame at the retracted position.

According to the above configuration, a risk that the movable guide member is damaged is reduced.

Aspect 18: The recording device, according to aspect 8, further includes a main body wherein the loading section is attached to the main body so as to be insertable into and removable from the main body, when the stacking portion is inserted into the main body, the stacking portion may come into contact with the movable guide member located at the retracted position, thereby displacing the movable guide member to the guide position. According to the above configuration, it is possible to reduce a risk that the medium is transported from the loading section in a state where the movable guide member is positioned at the retracted position.

What is claimed is:

1. A transport device configured to transport a medium stacked on a loading section, the transport device comprising:

a transport roller configured to transport the medium;

a separation roller opposed to the transport roller and separating the medium one sheet at a time;

a rotation shaft to which is attached the separation roller;

a movable guide member configured to guide the medium between the transport roller and the separation roller, to be aligned with the separation roller in a shaft direction of the rotation shaft, and to be movable in the shaft direction; and a holding member configured to hold the movable guide member, wherein the separation roller is attachable to and detachable from the rotation shaft by moving in the shaft direction, by moving in the shaft direction, the movable guide member is displaced between a guide position at which the medium is guided and a retracted position at which the separation roller is movable in the shaft direction with respect to the rotation shaft, and the holding member sets the position of the movable guide member located at the guide position.

2. The transport device, according to claim 1, wherein the movable guide member includes a movable guide face configured to guide the medium by contacting the medium, and the movable guide face extends, as viewed from the shaft direction, upstream and downstream in a transport direction in which the medium is transported with reference to a nip point where the transport roller and the separation roller nip the medium.

3. The transport device, according to claim 1, further comprising:

a fixed guide member that is arranged opposite to the movable guide member with respect to the separation roller in the shaft direction and that is configured to guide the medium, wherein the fixed guide member has a fixed guide face for guiding the medium by contacting the medium, the movable guide member has a movable guide face for guiding the medium by contacting the medium, and the movable guide face is located at the same height as the fixed guide face.

4. The transport device, according to claim 1, wherein the holding member includes a protrusion to be inserted into the movable guide member, an insertion hole into which the protrusion is inserted is opened in the movable guide member, the insertion hole extends in the shaft direction, and the width of the insertion hole is such that a region where the protrusion is located when the movable guide member is located at the guide position is smaller than a region where the protrusion is located when the movable guide member is located at the retracted position.

5. The transport device, according to claim 1, wherein the holding member contacts the movable guide member at a plurality of locations and sets the position of the movable guide member.

6. The transport device, according to claim 1, wherein the separation roller includes a grasping portion configured to be grasped by a user when the separation roller is attached to and detached from the rotation shaft and the grasping portion extends in the shaft direction and is positioned to not overlap the movable guide member located in the guide position in the shaft direction.

7. A recording device comprising:

a main body;

a loading section configured to stack a medium;

a transport roller configured to transport the medium stacked on the loading section;

a recording section configured to record an image on a medium transported by the transport roller;

a separation roller opposed to the transport roller and separating the medium one sheet at a time;

a rotation shaft to which is attached the separation roller; and a movable guide member configured to guide the medium between the transport roller and the separation roller, to be aligned with the separation roller in a shaft direction of the rotation shaft, and to be movable in the shaft direction, wherein the separation roller is attachable to and detachable from the rotation shaft by moving in the shaft direction, and by moving in the shaft direction, the movable guide member is displaced between a guide position at which the medium is guided and a retracted position at which the separation roller is movable in the shaft direction with respect to the rotation shaft, wherein, the loading section is attached to the main body so as to be insertable into and removable from the main body, when the loading portion is inserted into the main body, and the loading portion comes into contact with the movable guide member located at the retracted position, thereby displacing the movable guide member to the guide position.

8. The recording device, according to claim 7, wherein the movable guide member includes a movable guide face configured to guide the medium by contacting the medium, and the movable guide face extends, as viewed from the shaft direction, upstream and downstream in a transport direction in which the medium is transported with reference to a nip point where the transport roller and the separation roller nip the medium.

9. The recording device, according to claim 7, further comprising:

a fixed guide member that is arranged opposite to the movable guide member with respect to the separation roller in the shaft direction and that is configured to guide the medium, wherein the fixed guide member has a fixed guide face for guiding the medium by contacting the medium, the movable guide member has a movable guide face for guiding the medium by contacting the medium, and the movable guide face is located at the same height as the fixed guide face.

10. The recording device, according to claim 7, further comprising:

a holding member configured to hold the movable guide member, wherein the holding member sets the position of the movable guide member located at the guide position.

11. The recording device, according to claim 10, wherein the holding member includes a protrusion to be inserted into the movable guide member, an insertion hole into which the protrusion is inserted is opened in the movable guide member, the insertion hole extends in the shaft direction, and the width of the insertion hole is such that a region where the protrusion is located when the movable guide member is located at the guide position is smaller than a region where the protrusion is located when the movable guide member is located at the retracted position.

12. The recording device, according to claim 10, wherein the holding member contacts the movable guide member at a plurality of locations and sets the position of the movable guide member.

13. The recording device, according to claim 7, wherein the separation roller includes a grasping portion configured to be grasped by a user when the separation roller is attached to and detached from the rotation shaft and the grasping portion extends in the shaft direction and is positioned to not overlap the movable guide member located in the guide position in the shaft direction.

14. The recording device, according to claim 7, further comprising:

a main body;

a door configured to open and closed with respect to the main body; and a transport guide member configured to guide the medium transported by the transport roller toward the recording section, wherein the transport guide member is interlocked with the door and exposes the separation roller by opening the door.

15. The recording device, according to claim 14, wherein the movable guide member includes a grip member to be grasped by a user, and the grip member is exposed by opening the door.

16. The recording device, according to claim 7, further comprising:

a body frame, wherein the movable guide member is arranged inside the body frame at the retracted position.

* * * * *